US010883499B2

(12) United States Patent
Sakai et al.

(10) Patent No.: US 10,883,499 B2
(45) Date of Patent: Jan. 5, 2021

(54) FUEL PUMP INCLUDING A PROTRUDING PORTION AND CONNECTING AN INNER GEAR AND A ROTARY SHAFT

(71) Applicant: DENSO CORPORATION, Kariya (JP)

(72) Inventors: Hiromi Sakai, Kariya (JP); Daiji Furuhashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 463 days.

(21) Appl. No.: 15/544,532

(22) PCT Filed: Jan. 19, 2016

(86) PCT No.: PCT/JP2016/000248
§ 371 (c)(1),
(2) Date: Jul. 19, 2017

(87) PCT Pub. No.: WO2016/121334
PCT Pub. Date: Aug. 4, 2016

(65) Prior Publication Data

US 2018/0010606 A1 Jan. 11, 2018

(30) Foreign Application Priority Data

Jan. 27, 2015 (JP) ..... 2015-013545
Apr. 14, 2015 (JP) ..... 2015-082662

(51) Int. Cl.
*F03C 2/00* (2006.01)
*F03C 4/00* (2006.01)
(Continued)

(52) U.S. Cl.
CPC ..... *F04C 15/0061* (2013.01); *F04C 2/084* (2013.01); *F04C 2/102* (2013.01);
(Continued)

(58) Field of Classification Search
CPC ..... F04C 2/102; F04C 2/084; F04C 2/086; F04C 14/10; F04C 23/008; F04C 15/0049;
(Continued)

(56) References Cited

U.S. PATENT DOCUMENTS 419,241 A * 1/1890 Bitley ..... F16D 3/48 464/138
4,613,316 A * 9/1986 Reynolds ..... F16D 3/68 464/137
(Continued)

FOREIGN PATENT DOCUMENTS

JP 3-122283 12/1991
JP 6-123288 5/1994
JP 11-13640 1/1999

*Primary Examiner* — Theresa Trieu
(74) *Attorney, Agent, or Firm* — Nixon & Vanderhye P.C.

(57) ABSTRACT

An outer gear and an inner gear expand and contract volume of pump chambers formed between both the gears, and rotate to suction fuel into the pump chambers and then discharge fuel from the pump chambers sequentially. The inner gear includes an insertion hole that is depressed along its axial direction. A joint member includes a main body portion that is fitted to a rotary shaft, a foot portion that extends from the main body portion along the axial direction and is inserted in the insertion hole with a clearance therebetween, and a protruding portion that protrudes from the foot portion toward a rotation progress side of the inner gear and has its width in the axial direction further narrowed toward a top portion of the protruding portion.

2 Claims, 15 Drawing Sheets

(51) Int. Cl.

| | |
|---|---|
| ***F04C 2/00*** | (2006.01) |
| ***F04C 18/00*** | (2006.01) |
| ***F04C 15/00*** | (2006.01) |
| ***F04C 2/10*** | (2006.01) |
| ***F04C 2/08*** | (2006.01) |
| *F04C 13/00* | (2006.01) |

(52) U.S. Cl.
CPC ..... *F04C 15/008* (2013.01); *F04C 15/0073* (2013.01); *F04C 13/001* (2013.01); *F04C 2210/1044* (2013.01); *F04C 2230/603* (2013.01); *F04C 2240/30* (2013.01); *F04C 2240/40* (2013.01); *F04C 2240/60* (2013.01)

(58) Field of Classification Search
CPC ..... F04C 15/0023; F04C 15/0065; F04C 15/0073; F04C 15/0076; F04C 2210/1044; F04C 2210/203; F04C 2240/20; F04C 2240/60; F04C 2270/16; F02M 37/08; F02M 37/10; F16B 3/22; F16B 3/48; F16B 21/065; F16D 1/0876; F16D 1/108; F16D 1/112; Y10T 403/587; Y10T 403/7075
USPC ..... 418/15, 71, 166, 171, 131–133; 464/137–138; 403/319, 376
See application file for complete search history.

(56) References Cited

U.S. PATENT DOCUMENTS

| | | | | |
|---|---|---|---|---|
| 4,808,094 | A * | 2/1989 | Sugimoto | F04C 15/0073 418/182 |
| 5,006,048 | A * | 4/1991 | Jow | F04C 2/00 417/410.4 |
| 5,145,348 | A * | 9/1992 | Zumbusch | F04C 2/102 418/171 |
| 5,340,293 | A * | 8/1994 | Yasuda | F04C 2/102 418/171 |
| 2002/0122736 | A1* | 9/2002 | Takagi | F04C 2/102 418/171 |
| 2006/0228174 | A1* | 10/2006 | Woodhead | Y10T 403/7075 403/376 |
| 2008/0112821 | A1 | 5/2008 | Morris | |

* cited by examiner

FUEL PUMP INCLUDING A PROTRUDING PORTION AND CONNECTING AN INNER GEAR AND A ROTARY SHAFT

CROSS REFERENCE TO RELATED APPLICATIONS

This application is the U.S. national phase of International Application No. PCT/JP2016/000248 filed on Jan. 19, 2016 which designated the U.S. and claims priority to Japanese Patent Application No. 2015-13545 filed on Jan. 27, 2015, and Japanese Patent Application No. 2015-82662 filed on Apr. 14, 2015, the entire contents of each of which are incorporated herein by reference.

TECHNICAL FIELD

The present disclosure relates to a fuel pump that sequentially sucks fuel into respective pump chambers and discharges the fuel from the respective pump chambers.

BACKGROUND ART

There has been known a fuel pump that sequentially sucks fuel into respective pump chambers and discharges the fuel from the respective pump chambers. A fuel pump disclosed in Patent Document 1 includes: an outer gear that has a plurality of internal teeth; an inner gear that has a plurality of external teeth and that is engaged with (fitted to) the inner gear in such a way as to be eccentric in an eccentric direction; a pump housing that houses both of the gears in such a way that both of the gears can be rotated; and an electric motor that has a rotary shaft to be rotated and driven. The outer gear and the inner gear rotate (on a rotation progress side) while expanding or reducing the volumes of a plurality of pump chambers formed between both of the gears, thereby sequentially sucking or discharging the fuel into or from the respective pump chambers.

Then, a coupling couples the rotary shaft to the inner gear. In this coupling, a protruding portion to protrude to a radial direction side is engaged with an inner wall groove of the inner gear.

PRIOR ART DOCUMENT

Patent Document

Patent Document 1: JP H6-123288A

However, the fuel pump disclosed in the Patent Document 1 presents the following problem: that is, in a case where the rotary shaft is shifted in position and the coupling is inclined, the inner gear is pushed by receiving a force in an axial direction and hence is not smoothly rotated and a pump efficiency is reduced.

Further, in the coupling of the fuel pump disclosed in the Patent Document 1, it is a plane surface of a protruding portion that is opposed in a circumferential direction to a plane surface of an inner wall groove of the inner gear. In this construction, in a case where the a contact position or a contact angle of the coupling to the inner gear is changed by a shift of the rotary shaft or the like, there is a case where a component force in a direction other than a circumferential direction is generated in a driving force transmitted to the inner gear from the coupling or a case where an edge of the protruding portion in a radial direction hits on a plane surface portion of the inner wall groove, whereby a load is concentrated on the edge portion. A pump efficiency is likely to be reduced by these phenomena.

SUMMARY OF INVENTION

The present disclosure addresses the above issues. Thus, it is an objective of the present disclosure to provide a fuel pump that has a high pump efficiency.

To achieve the objective, a fuel pump in a first aspect of the present disclosure includes an outer gear that includes a plurality of internal teeth, an inner gear that includes a plurality of external teeth and is eccentric from the outer gear in an eccentric direction to be engaged with the outer gear, a pump housing that rotatably accommodates the outer gear and the inner gear, an electric motor that includes a rotary shaft which is rotary-driven, and a joint member that connects together the inner gear and the rotary shaft. The outer gear and the inner gear expand and contract volume of a plurality of pump chambers formed between both the gears, and rotate to suction fuel into the plurality of pump chambers and then discharge fuel from the plurality of pump chambers sequentially. The inner gear includes an insertion hole that is depressed along its axial direction. The joint member includes a main body portion that is fitted to the rotary shaft, a foot portion that extends from the main body portion along the axial direction and is inserted in the insertion hole with a clearance therebetween, and a protruding portion that protrudes from the foot portion toward a rotation progress side of the inner gear and has its width in the axial direction further narrowed toward a top portion of the protruding portion.

According to this aspect, when the rotary shaft of the electric motor is rotated and driven, the joint member having the main body portion that is fitted to the rotary shaft is rotated together with the rotary shaft. Then, each of the foot portions extended in the axial direction from the main body portion is inserted into each of the insertion holes of the inner gear with the clearance and hence the inner gear can be rotated. Here, each of the protruding portions protrudes to the rotation progress side of the inner gear from the foot portion, so that the inner gear is rotated in a state where the protruding portion is in contact with the inner circumferential wall of the inner gear. According to this construction, even in a case where the rotary shaft is shifted in position and hence the joint member is inclined, the foot portion can be prevented from being brought into contact with an edge portion of the insertion hole. Hence, the inner gear can be prevented from being pushed by receiving a force in the axial direction and hence can be smoothly rotated. Hence, it is possible to provide the fuel pump having a high pump efficiency.

To achieve the objective, a fuel pump in a second aspect of the present disclosure includes an outer gear that includes a plurality of internal teeth, an inner gear that includes a plurality of external teeth and is eccentric from the outer gear in an eccentric direction to be fitted to the outer gear, a pump housing that rotatably accommodates the outer gear and the inner gear, an electric motor that includes a rotary shaft which is rotary-driven, and a joint member that connects together the inner gear and the rotary shaft to rotate the inner gear in its circumferential direction. The outer gear and the inner gear expand and contract volume of a plurality of pump chambers formed between both the gears, and rotate to suction fuel into the plurality of pump chambers and then discharge fuel from the plurality of pump chambers sequentially. The inner gear includes an insertion hole that is depressed along its axial direction. The joint member includes a main body portion that is fitted to the rotary shaft, and a foot portion that extends from the main body portion along the axial direction and is inserted in the insertion hole with a clearance therebetween. The insertion hole includes a plane portion along a radial direction of the inner gear on its inner wall on a drive rotation side of the foot portion. The foot portion includes a top portion that is opposed to the plane portion in the circumferential direction and that is curved in a protruding shape when viewed on its plan view.

According to this aspect, when the rotary shaft of the electric motor is rotated and driven, the joint member having the main body portion that is fitted to the rotary shaft is rotated together with the rotary shaft. Then, the foot portion extended along the axial direction from the main body portion is inserted into the insertion hole of the inner gear with a clearance, so that the inner gear is rotated in the circumferential direction by way of the joint member. Here, in the insertion hole, the inner wall on the drive rotation side with respect to the foot portion has the plane portion along the radial direction. On the other hand, in the foot portion, the top portion curved in the protruding shape when viewed on the plan view is opposed in the circumferential direction to the plane portion. According to this construction, even in a case where a contact position or a contact angle of the foot portion with respect to the insertion hole is changed, when the top portion is brought into contact with the plane portion, it is possible to inhibit a component force in the radial direction from being generated in a driving force transmitted to the inner gear from the joint member and to inhibit a load from being concentrated at a specified portion of the joint member, so that the inner gear can be rotated efficiently for a long time. From the above, it is possible to provide the fuel pump having a high pump efficiency.

BRIEF DESCRIPTION OF THE DRAWINGS

The above and other objects, features and advantages of the present disclosure will become more apparent from the following detailed description made with reference to the accompanying drawings. In the drawings.

EMBODIMENTS FOR CARRYING OUT INVENTION

First Embodiment

Hereinafter, a first embodiment will be described on the basis of the drawings.

Figure 1:
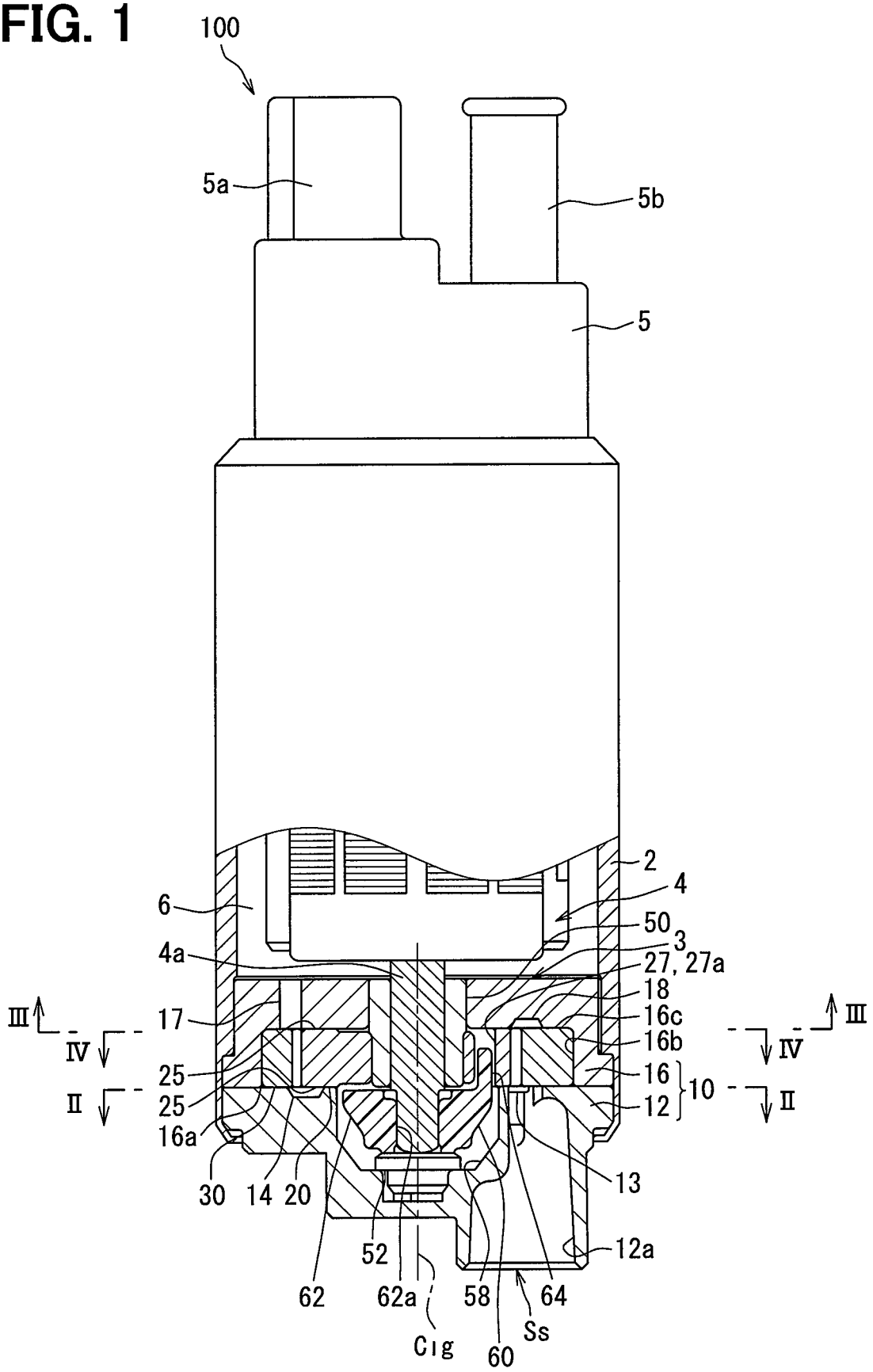
FIG. 1 is a front view, partly in cross section, to show a fuel pump according to a first embodiment.

As shown in FIG. 1, a fuel pump 100 according to the first embodiment is a displacement type trochoid pump which is mounted in a vehicle. The fuel pump 100 is provided with a pump main body 3, which is received in a circular cylindrical pump body 2, and a side cover 5, which is projected to the outside from an end on a side opposite to the pump main body 3 across an electric motor 4 in an axial direction. Here, the side cover 5 is provided with an electric connector 5*a* to energize the electric motor 4 and a discharge port 5*b* to discharge fuel. In this fuel pump 100, when electricity is supplied from an external circuit via the electric connector 5*a*, a rotary shaft 4*a* of the electric motor 4 is rotated and driven. As a result, the fuel sucked and pressurized by the pump main body 3 by the use of a driving force of the rotary shaft 4*a* of the electric motor 4 is discharged from the discharge port 5*b*. In this regard, the fuel pump 100 discharges light oil, which has a higher viscosity than gasoline, as fuel.

In the present embodiment, a brushless motor of an inner rotor type in which magnets are arranged at four poles is employed as the electric motor 4. The rotary shaft 4*a* of the electric motor 4 is rotated in a direction reverse to a normal rotation direction at the time of startup (in other words, is rotated in a direction reverse to a rotation direction Rig, which will be described later).

In this regard, in the following description, a rotation progress side indicates a positive direction side in the rotation direction Rig. Further, a rotation reverse side indicates a negative direction side in the rotation direction Rig.

Hereinafter, the pump main body 3 will be described in detail. The pump main body 3 includes: a pump housing 10, an inner gear 20, an outer gear 30, and a joint member 60. Here, the pump housing 10 is made by combining a pump cover 12 with a pump casing 16.

The pump cover 12 is formed of metal in a shape of a circular disk. The pump cover 12 is projected to the outside from an end on a side opposite to the side cover 5 across the electric motor 4 of the pump body 2 in the axial direction.

Figure 2:
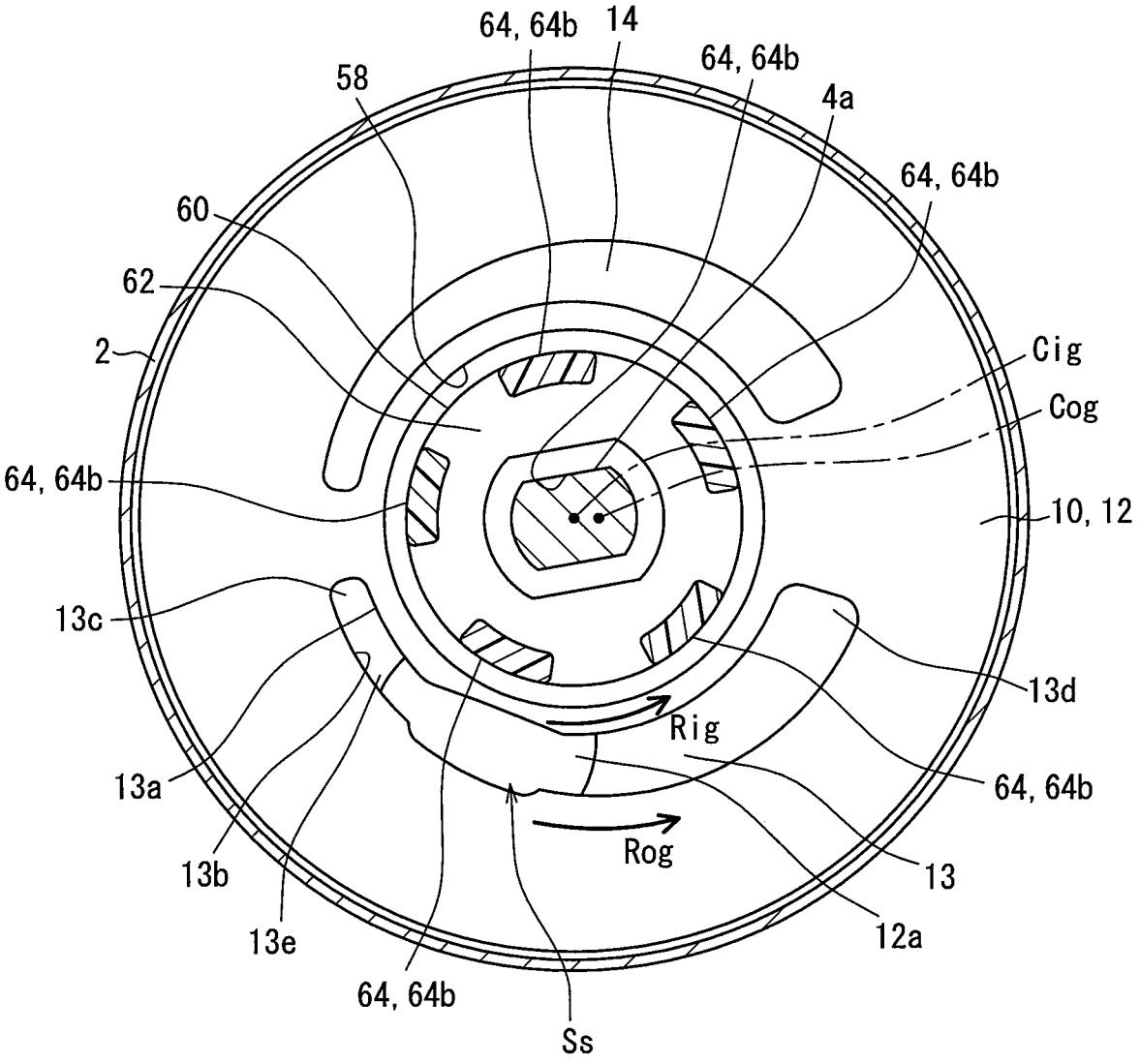
FIG. 2 is a section view taken along a line II-II in FIG. 1.

The pump cover 12 shown in FIG. 1 and FIG. 2 forms a suction port 12*a*, which is formed in a shape of a circular cylindrical hole, and a suction passage 13, which is formed in a shape of an arc groove. The suction port 12*a* is passed through a specified opening portion Ss, which is eccentric from an inner center line Cig of the inner gear 20 of the pump cover 12, along the axial direction of the pump cover 12. The suction passage 13 is opened on a pump casing 16 side of the pump cover 12. As shown in FIG. 2, an inner circumferential portion 13*a* of the suction passage 13 is extended to a length less than half a circumference along the rotation direction Rig of the inner gear 20 (see also FIG. 4). An outer circumferential portion 13*b* of the suction passage 13 is extended to a length less than half a circumference along a rotation direction Rog of the outer gear 30.

Here, the suction passage 13 has a width expanded gradually to a finish end portion 13*d* of the rotation directions Rig, Rog from a start end portion 13*c*. Further, the suction passage 13 has the suction port 12*a* opened at the opening portion Ss of a groove bottom portion 13*e*, thereby communicating with the suction port 12*a*. As especially shown in FIG. 2, in the whole area of the opening portion Ss in which the suction port 12*a* is opened, the width of the suction passage 13 is set smaller than a diameter of the suction port 12*a*.

Further, the pump cover 12 forms an arrangement space 58, which is formed in a shape of a depressed hole and in which a main body portion 62 of the joint member 60 is arranged in such a way as to rotate, at a position opposite to the inner gear 20 on the inner center line Cig.

Figure 3:
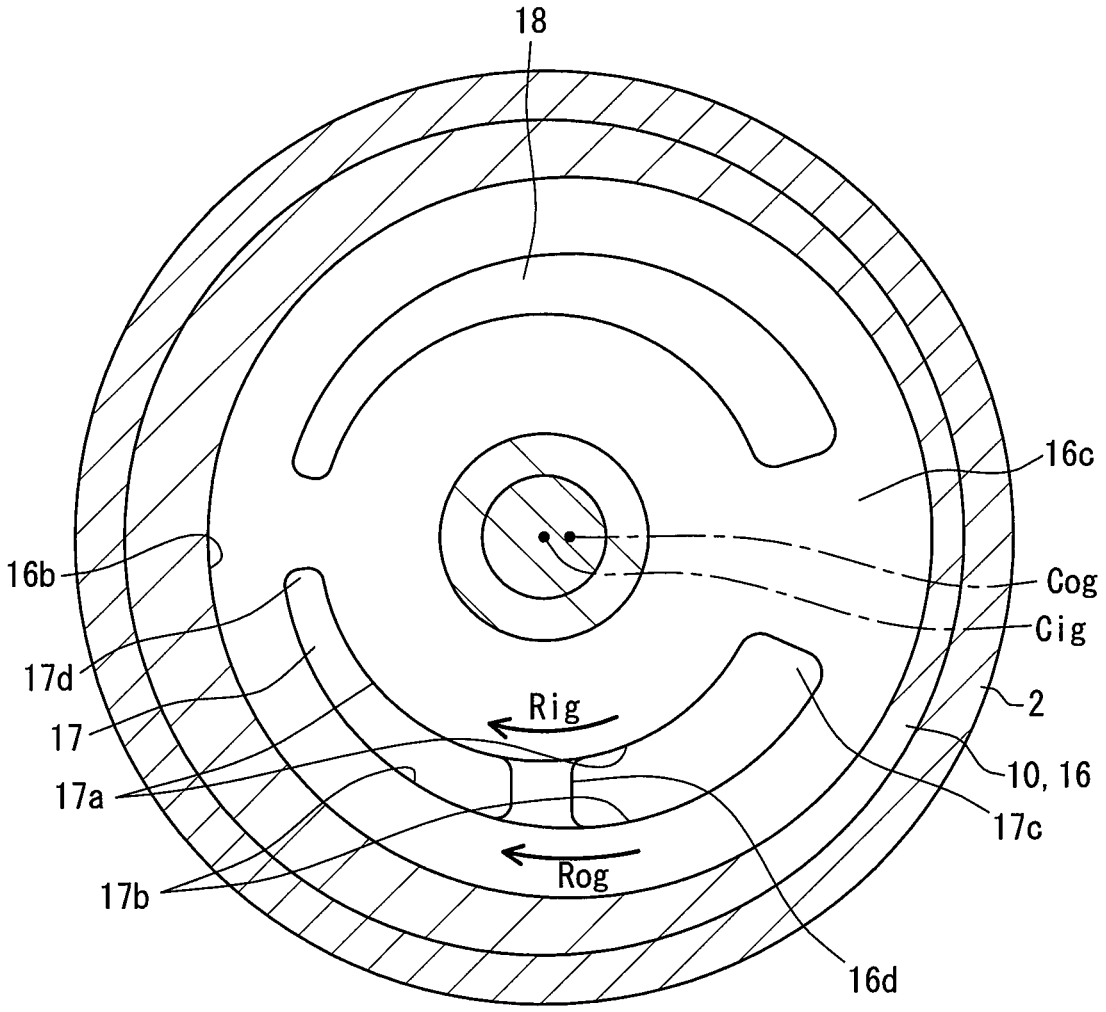
FIG. 3 is a section view taken along a line III-III in FIG. 1.
Figure 4:
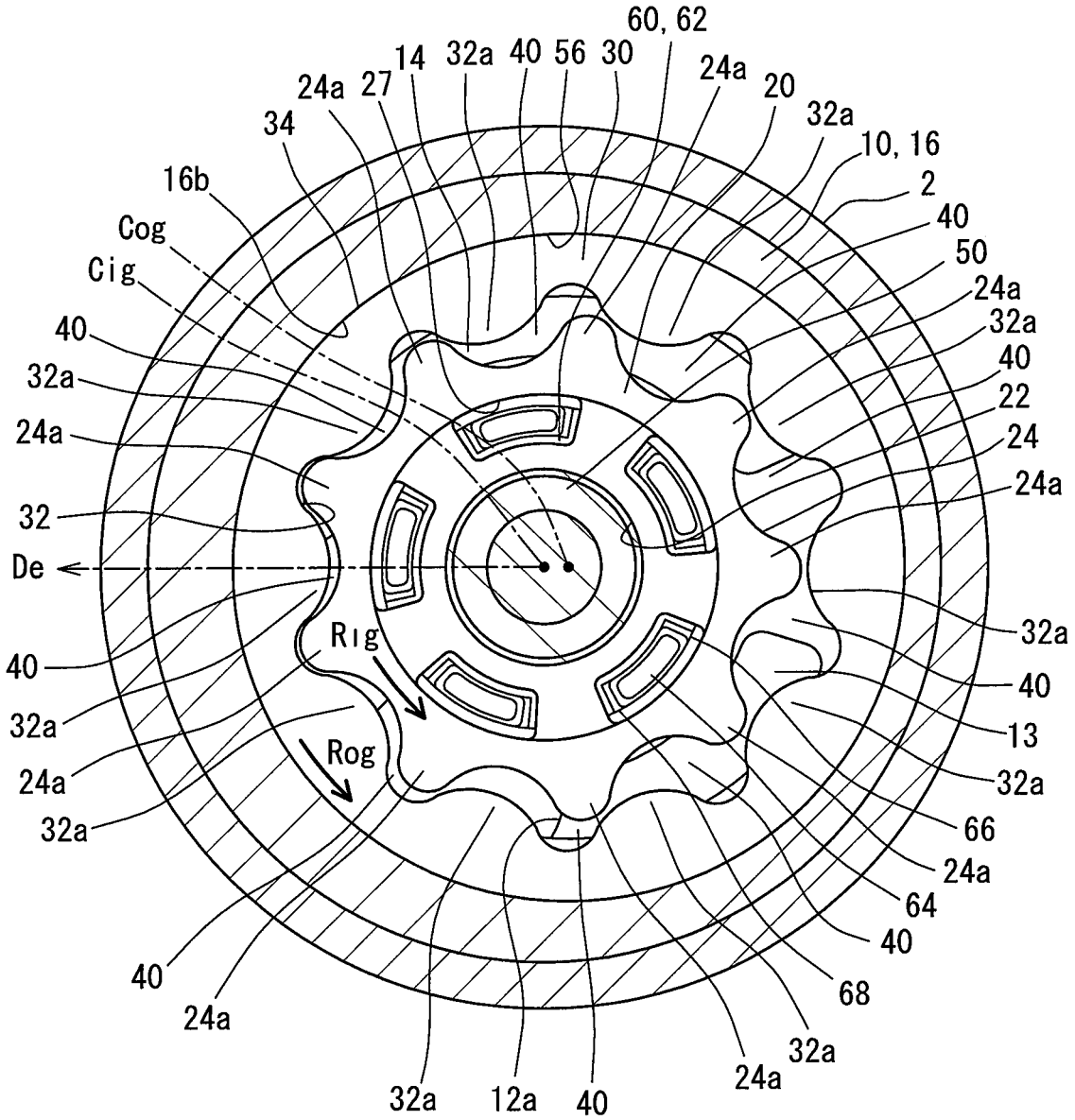
FIG. 4 is a section view taken along a line IV-IV in FIG. 1.

The pump casing 16 shown in FIGS. 1, 3, and 4, is formed of metal in a shape of a closed-end circular cylinder. An opening portion 16*a* of the pump casing 16 is covered by the pump cover 12, thereby being tightly closed in the whole circumference. An inner circumferential portion 16*b* of the pump casing 16, as especially shown in FIGS. 1 and 4, is formed in a shape of a circular cylindrical hole which is eccentric from the inner center line Cig of the inner gear 20.

The pump casing 16 forms a discharge passage 17 formed in a shape of an arc hole so as to discharge the fuel from the discharge port 5*b* through a fuel passage 6 between the pump body 2 and the electric motor 4. The discharge passage 17 is passed through a depressed bottom portion 16*c* of the pump casing 16 along an axial direction. As especially shown in FIG. 3, an inner circumferential portion 17*a* of the discharge passage 17 is extended to a length less than half a circumference along the rotation direction Rig of the inner gear 20. An outer circumferential portion 17*b* of the discharge passage 17 is extended to a length less than half a circumference along the rotation direction Rog of the outer gear 30. Here, the discharge passage 17 has a width narrowed gradually to a finish end portion 17*d* of the rotation directions Rig, Rog from a start end portion 17*c*.

Further, the pump casing 16 has a reinforcing rib 16*d* provided in the discharge passage 17. The reinforcing rib 16*d* is a rib which is formed integrally with the pump casing 16 and which is extended over the discharge passage 17 in an intersecting direction with respect to the rotation direction Rig of the inner gear 20 to thereby reinforce the pump casing 16.

Of the depressed bottom portion 16*c* of the pump casing 16, at a portion opposite to the suction passage 13 across the pump chamber 40 (which will be described later in detail) between both of the inner gear 20 and the outer gear 30, as especially shown in FIG. 3, a suction groove 18 formed in a shape of an arc groove is formed in correspondence to a shape in which the suction passage 13 is projected in the axial direction. In this way, in the pump casing 16, the discharge passage 17 and the suction groove 18 are formed in such a way that their contours are nearly symmetric to each other with respect to a line. On the other hand, as especially shown in FIG. 2, at a portion opposite to the discharge passage 17 across the pump chamber 40 of the pump cover 12, a discharge groove 14 formed in a shape of an arc groove is formed in correspondence to a shape in which the discharge passage 17 is projected in the axial direction. In this way, in the pump cover 12, the suction passage 13 and the discharge groove 14 are formed in such a way that their contours are nearly symmetric to each other with respect to a line.

As shown in FIG. 1, on the inner center line Cig of the depressed bottom portion 16*c* of the pump casing 16, a radial bearing 50 is fitted and fixed so as to journal the rotary shaft 4*a* of the electric motor 4 in a radial direction. On the other hand, on the inner center line Cig of the pump cover 12, a thrust bearing 52 is fitted and fixed so as to journal the rotary shaft 4*a* in the axial direction.

As shown in FIGS. 1 and 4, the depressed bottom portion 16*c* and the inner circumferential portion 16*b* of the pump casing 16 form a housing space 56, which houses the inner gear 20 and the outer gear 30, in cooperation with the pump cover 12. Each of the inner gear 20 and the outer gear 30 is a so-called trochoid gear whose tooth shape curve is a trochoid curve.

Figure 5:
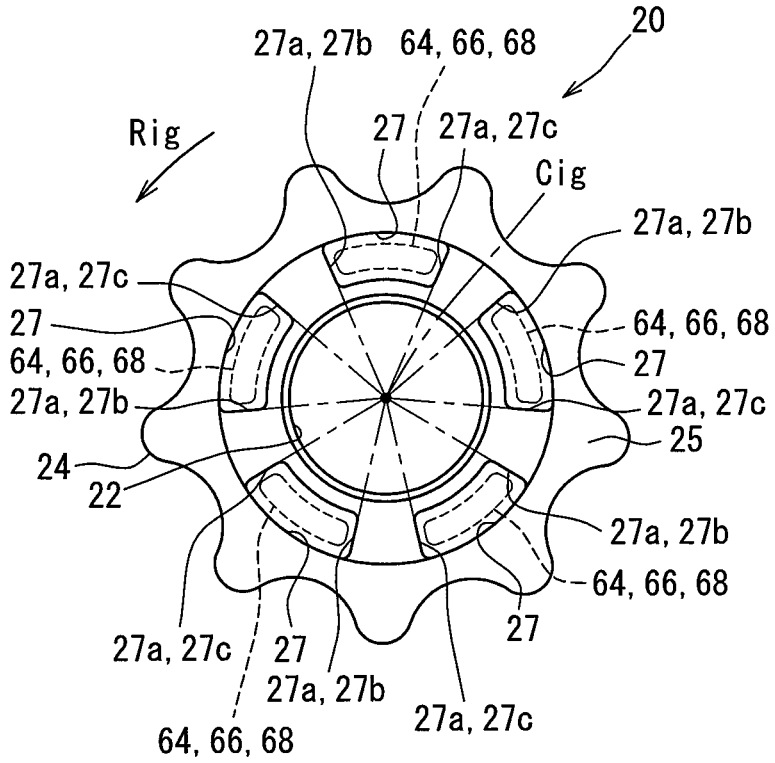
FIG. 5 is a view when an inner gear according to the first embodiment is viewed from an arrangement space side.

The inner gear 20 shown in FIGS. 1, 4, and 5 has the inner center line Cig in common with the rotary shaft 4*a*, so that the inner gear 20 is eccentrically arranged in the housing space 56. The inner gear 20 has its inner circumferential portion 22 journaled in the radial direction by the radial bearing 50 and has its sliding surface 25 on both sides in the axial direction journaled by the depressed bottom portion 16*c* of the pump casing 16 and the pump cover 12.

Further, the inner gear 20 has an insertion hole 27 depressed along the axial direction at a position opposite to the arrangement space 58. In the present embodiment, the insertion hole 27 is formed plurally at equal intervals in a circumferential direction along the rotation direction Rig, and each of the insertions holes 27 is passed through to the depressed bottom portion 16*c* side. Each of the insertion holes 27 has a corresponding foot portion 64 of the joint portion 60 inserted thereinto, whereby a driving force of the rotary shaft 4*a* is transmitted to the inner gear 20 via the joint member 60. In this way, the inner gear 20 can make the sliding surface 25 slide to the depressed bottom portion 16*c* and the pump cover 12 according to the rotation of the rotary shaft 4*a* of the electric motor 4, whereby the inner gear 20 can be rotated in the specified rotation direction Rig around the inner center line Cig.

The inner gear 20 has a plurality of external teeth 24*a*, which are arranged at equal intervals in that rotation direction Rig, on an outer circumferential portion 24. Each of the external teeth 24*a* can be opposed in the axial direction to each of the suction passage 13 and the discharge passage 17 and each of the discharge groove 14 and the suction groove 18 according to the rotation of the inner gear 20, whereby each of the external teeth 24*a* is inhibited from being attached to the depressed bottom portion 16*c* and the pump cover 12.

Further, each of the insertion holes 27 of the present embodiment has plane portions 27*b*, each of which is formed on an inner circumferential wall on the rotation progress side of each inner circumferential wall 27*a*, and plane portions 27*b*, each of which is formed on an inner circumferential wall on the rotation reverse side of each inner circumferential wall 27*a*, each of the plane portions 27*b*, 27*c* being formed in a shape of a plane along the radial direction of the inner gear 20.

The outer gear 30 shown in FIGS. 1 and 4 is eccentrically arranged with respect to the inner center line Cig of the inner gear 20, so that in the housing space 56, the outer gear 30 is arranged coaxially to the housing space 56. In this way, the inner gear 20 is eccentric to an eccentric direction De as one radial direction with respect to the outer gear 30. An outer circumferential portion 34 of the outer gear 30 is journaled in the radial direction by the inner circumferential portion 16*b* of the pump casing 16 and is journaled in the axial direction by the depressed bottom portion 16*c* of the pump casing 16 and the pump cover 12. Since the outer gear 30 is journaled in this way, the outer gear 30 can be rotated in a specified rotation direction Rog around an outer center line Cog which is eccentric from the inner center line Cig.

The outer gear 30 has a plurality of internal teeth 32*a* formed on an inner circumferential portion 32 thereof, the plurality of internal teeth 32*a* being arranged at equal intervals in that rotation direction Rog. Here, the number of the internal teeth 32*a* in the outer gear 30 is set larger by one than the number of the external teeth 24*a* in the inner gear 20. Each of the internal teeth 32*a* can be opposed in the axial direction to each of the suction passage 13 and the discharge passage 17 and each of the discharge groove 14 and the suction groove 18 according to the rotation of the outer gear 30, whereby each of the internal teeth 32*a* is inhibited from being attached to the depressed bottom portion 16*c* and the pump cover 12.

The inner gear 20 is engaged with the outer gear 30 in a state where inner gear 20 is relatively eccentric to the eccentric direction De with respect to the outer gear 30. In this way, a plurality of pump chambers 40 are formed continuously between both of the inner gear 20 and the outer gear 30 in the housing space 56. When the outer gear 30 and the inner gear 20 are rotated, each of the pump chambers 40 has its volume enlarged or reduced.

When both of the inner gear 20 and the outer gear 30 are rotated, the pump chamber 40, which is opposed to and communicates with the suction passage 13 and the suction groove 18, has its volume enlarged. As a result, the fuel is sucked into the pump chamber 40 through the suction passage 13 from the suction port 12*a*. Here, the suction passage 13 has its width enlarged gradually to a finish end portion 13*d* from a start end portion 13*c* (see also FIG. 2), so that the amount of the fuel sucked through the suction passage 13 depends on the amount of enlarged volume of the pump chamber 40.

When both of the inner gear 20 and the outer gear 30 are rotated, the volume of the pump chamber 40, which is opposed to and communicates with the discharge passage 17 and the discharge groove 14, is reduced. As a result, at the same time of a suction function described above, the fuel is discharged to the fuel passage 6 through the discharge passage 17 from the pump chamber 40. Here, the discharge passage 17 has its width reduced gradually to the finish end portion 13*d* from the start end portion 13*c* (see also FIG. 3), so that the amount of the fuel discharged through the discharge passage 17 depends on the amount of reduced volume of the pump chamber 40.

The joint member 60, as shown in FIGS. 1, 2, 4, 6, and 7, is formed of synthetic resin, for example, polyphenylene sulfide resin or the like, and transmits the driving force of the rotary shaft 4*a* to the inner gear 20. The joint member 60 includes a main body portion 62, the foot portion 64, a protruding portion 66, and a reverse protruding portion 68.

The main body portion 62 is arranged in the arrangement space 58 formed in the pump cover 12 and is formed in a shape of a circular ring having a fitting hole 62*a* opened in the center and has the rotary shaft 4*a* passed through the fitting hole 62*a*, thereby being fitted and fixed to the rotary shaft 4*a*.

The foot portion 64 is plurally provided in correspondence to the number of the insertions holes 27 of the inner gear 20. Specifically, the foot portions 64 are provided by a number which is different from the number of the poles of the magnets of the electric motor 4 and which is, in particular, a prime number, that is, by five. The foot portions 64 formed in this manner are provided alongside in the circumferential direction. Each of the foot portions 64 is extended in the axial direction from the main body portion 62 and is inserted into the corresponding insertion hole 27 with a clearance. In each insertion hole 27 passed through the inner gear 20 in the axial direction, a tip 64*a* of each foot portion 64 is extended in the axial direction in such a way as to reach the electric motor 4 side farther than a center of gravity of the inner gear 20 and not to reach the outside of the insertion hole 27.

The protruding portion 66 is plurally provided in correspondence to the number of the insertion holes 27 and the foot portions 64. Each of the protruding portions 66 protrudes to a rotation direction side of the inner gear 20 from the corresponding foot portion 64. Each of the protruding portions 66 of the present embodiment protrudes on the main body portion 62 side of the tip 64*a* in such a way as to avoid the tip 64*a* of each of the foot portions 64.

Figure 6:
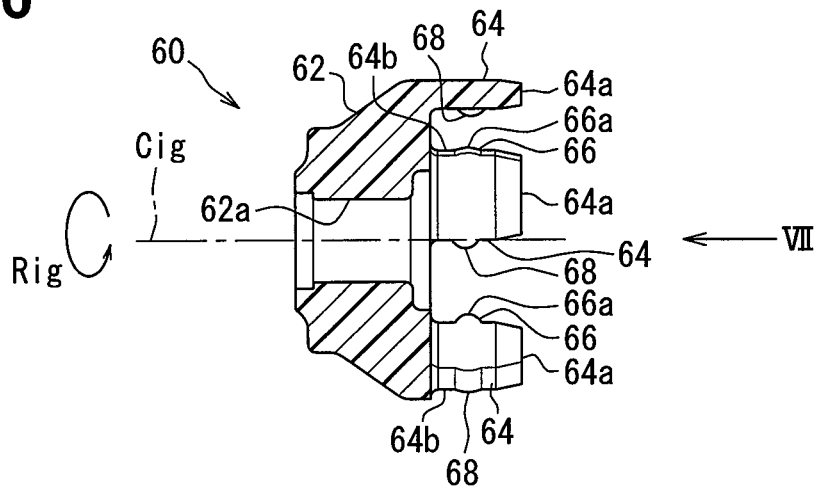
FIG. 6 is a section view to show a joint member according to the first embodiment.
Figure 7:
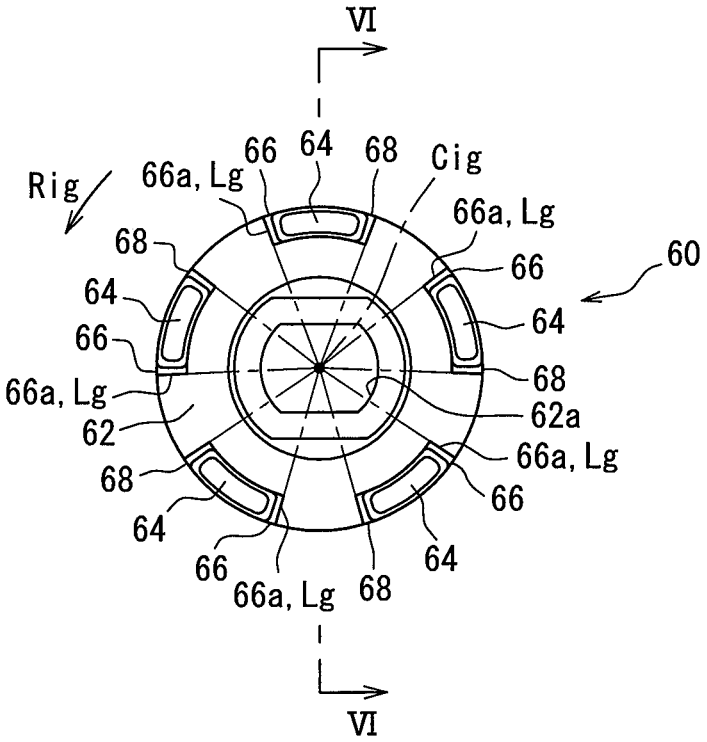
FIG. 7 is a view when viewed from a direction shown by an arrow of VII in FIG. 6.
Figure 8:
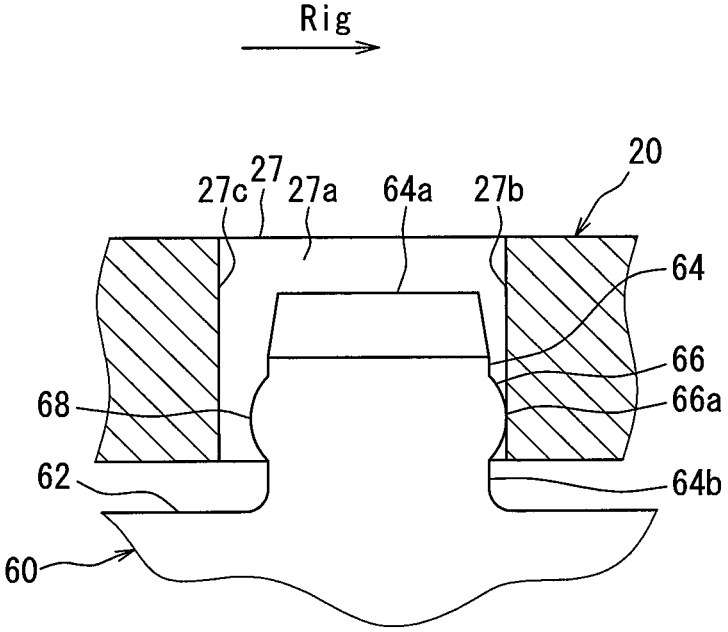
FIG. 8 is a view to illustrate contact between the joint member and the inner gear of the first embodiment.

Each of the protruding portions 66 is formed in such a way as to have a width in the axial direction narrowed gradually to its top portion 66*a*. Specifically, each of the protruding portions 66 protrudes in a shape of a curving protruding surface having a curvature in the axial direction, and in more detail, as especially shown in FIG. 7, protrudes in a shape of a partial circular cylindrical surface having a generating line Lg along the radial direction. Each of the top portions 66*a* is located in the insertion hole 27 together with the tip 64*a* of the corresponding foot portion 64 (see also FIG. 8). As can be seen in FIGS. 6 and 8 for example, each protruding portion 66 has the width in the axial direction narrowed toward the top portion 66*a* of the protruding portion 66. The width of the protruding portion 66 has another end, which is narrowed toward the main body portion 62, so that the protruding portion 66 is separated from the main body portion 62 with a predetermined axial distance between the other end of the width of the protruding portion 62 and the main body portion 62. FIGS. 6 and 8 thus the protruding portion 66 is at a position separate or spaced apart from the main body portion 62 in the axial direction by the predetermined axial distance.

The reverse protruding portion 68, similarly to the protruding portion 66, is also plurally provided in correspondence to the number of the insertion holes 27 and the foot portions 64. Each of the reverse protruding portions 68 protrudes to a rotation reverse side of the inner gear 20 from the corresponding foot portion 64. Each of the reverse protruding portions 68 protrudes in a shape similar to the protruding portion 66 and is nearly symmetric to the protruding portion 66 with respect to a line across a bisector of the foot portion 64.

Because the joint member 60 is formed in this shape, a base end portion 64*b* of each foot portion 64 is formed in a shape narrowed with respect to the main body portion 62 and the corresponding protruding portion 66 and with respect to the main body portion 62 and the corresponding reverse protruding portion 68.

Figure 9:
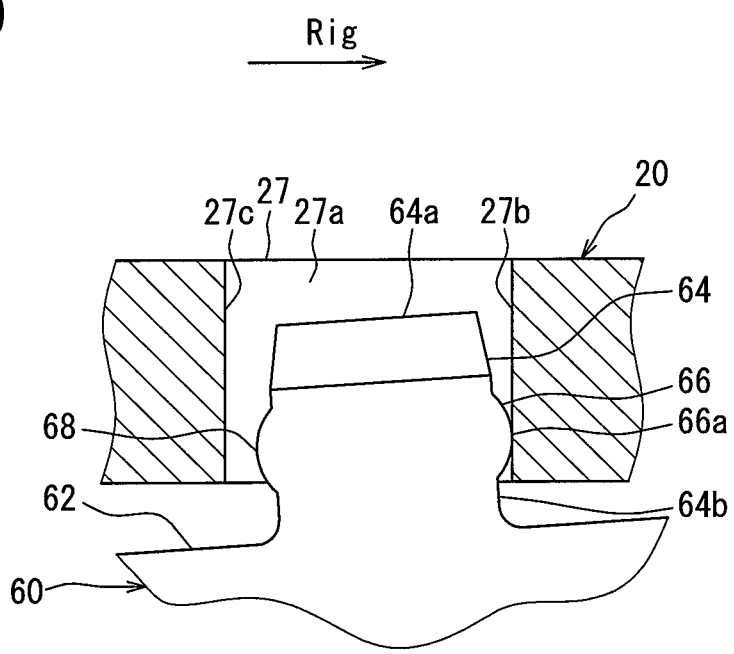
FIG. 9 is a view to illustrate contact between the joint member and the inner gear of the first embodiment and shows a case in which the joint member is inclined.

When the rotary shaft 4*a* is rotated and driven, depending on a state in which the rotary shaft 4*a* is shifted in position, for example, two or three protruding portions 66 of the five protruding portions 66, as shown in FIG. 8, are simultaneously brought into contact with the plane portion 27*b* on the inner circumferential wall 27*a* on the rotation progress side with respect to the protruding portion 66 in the corresponding insertion hole 27. Further, even in a case where the rotary shaft 4*a* receives vibrations (for example, vehicle vibrations) from the outside and hence is shifted in position with respect to the inner center line Cig and hence the joint member 60 is inclined to the inner gear 20 as shown in FIG. 9, a portion, which is formed in the shape of the curving protruding surface and is shifted from the top portion 66*a* of the protruding portion 66, is brought into contact with the plane portion 27*b*.

In the joint member 60 formed of a resin material, it is concerned that the protruding portion 66 is worn by the contact. However, in the present embodiment, in a case where the joint member 60 is inclined, the portion, which is formed in the shape of the curving protruding surface and is shifted in position from the top portion 66*a* of the protruding portion 66 according to an inclined angle, is brought into contact with the plane portion 27*b*, which hence prevents only a specified portion of the protruding portion 66 from being significantly worn. Further, in the joint member 60 formed of the resin material, the foot portion is likely to be deformed by thermal expansion, swelling by the fuel, or the contact described above. However, even in a case where the foot portion is slightly deformed in this manner, any of the portion formed in the shape of the curving protruding surface of the protruding portion 66 is brought into contact with the plane portion 27*b*.

In this way, the driving force of the rotary shaft 4*a* is transmitted to the inner gear 20 by way of the joint member 60 and the inner gear 20 is rotated in the rotation direction Rig. Then, the fuel is sucked sequentially into the respective pump chambers 40 and then is discharged from the respective pump chambers 40 by the fuel pump 100.

An operation and effect of the present embodiment described above will be described below.

According to the present embodiment, when the rotary shaft 4*a* of the electric motor 4 is rotated and driven, the joint member 60 having the main body portion 62 fitted to the rotary shaft 4*a* is rotated together with the rotary shaft 4*a*. Then, each of the foot portions 64 extended in the axial direction from the main body portion 62 is inserted into each of the insertion holes 27 of the inner gear 20 with the clearance and hence the inner gear 20 can be rotated. Here, each of the protruding portions 66 protrudes to the rotation progress side of the inner gear 20 from the corresponding foot portion 64, so that the inner gear 20 is rotated in a state where the protruding portion 66 is in contact with the inner circumferential wall 27*a* of the inner gear 20. According to this construction, even in a case where the rotary shaft 4*a* is shifted in position and hence the joint member 60 is inclined, the foot portion 64 can be prevented from being brought into contact with an edge portion of the insertion hole 27. Hence, the inner gear 20 can be prevented from being applied and pushed in the axial direction by a force and can be smoothly rotated. Hence, it is possible to provide the fuel pump 100 having a high pump efficiency.

Further, according to the present embodiment, each of the protruding portions 66 protrudes in the shape of the curving protruding surface having a curvature in the axial direction. In a case where the rotary shaft 4*a* is shifted in position and the joint member 60 is inclined, the protruding portion 66 formed in the shape of the curving protruding surface can be brought into contact with the insertion hole 27 along the axial direction. For this reason, the inner gear 20 can be more surely prevented from being applied and pushed in the axial direction by the force and hence can be smoothly rotated, which hence can increase a pump efficiency.

Still further, according to the present embodiment, each of the insertion holes 27 has the plane portion 27*b* along the radial direction on the inner circumferential wall 27*a* on the rotation progress side with respect to the protruding portion 66, and each of the protruding portions 66 protrudes in the shape of the partial circular cylindrical surface having the generating line Lg along the radial direction. The protruding portion 66 is brought into line contact with the plane portion 27*b* and hence the driving force of the rotary shaft 4*a* is efficiently transmitted to the inner gear 20 in the rotation direction Rig, so that the inner gear 20 can be smoothly rotated and hence the pump efficiency can be increased.

Still further, according to the present embodiment, each of the protruding portions 66 protrudes on the main body portion 62 side of the tip 64*a* of the corresponding foot portion 64. Hence, when the fuel pump 100 is manufactured, the tip 64*a* of the foot portion 64 can be easily inserted into the insertion hole 27 and the tip 64*a* of the foot portion 64 functions as a guide, whereby the protruding portion 66 can be easily inserted into the corresponding insertion hole 27. Hence, the joint member 60 can be easily combined with the inner gear 20.

Still further, according to the present embodiment, the insertion hole 27 is plurally provided and each of the foot portion 64 and the protruding portion 66 is plurally provided in correspondence to the insertion holes 27. According to this, in a case where the rotary shaft 4*a* is shifted in position and the joint member 60 is inclined, the protruding portion 66 can be brought into contact with the inner circumferential wall 27*a* of the insertion hole 27 in correspondence to various inclinations of the joint member 60 and hence the pump efficiency can be improved.

Still further, according to the present embodiment, the joint member 60 has the reverse protruding portions 68, each of which protrudes in the same shape as the protruding portion 66 to the rotation reverse side of the inner gear 20 from the foot portion 64. According to this, even in a case where the rotary shaft 4*a* is rotated to the rotation reverse side, for example, at the time of starting up the electric motor 4, it is possible to prevent the foot portion 64 from being brought into contact with the edge of the insertion hole 27 and to prevent the inner gear 20 from being applied and pushed in the axial direction by the axial force, so that the inner gear 20 can be smoothly rotated.

The first embodiment has been described above. However, the present disclosure is not understood to be limited to the embodiment but can be applied to various embodiments within a scope not departing from the gist of the present disclosure. Modifications of the embodiment described above will be described below.

Figure 10:
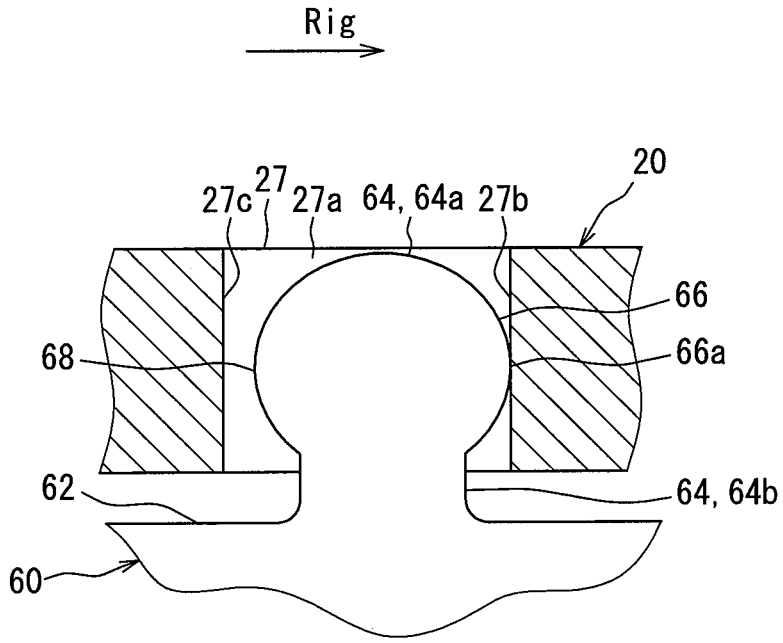
FIG. 10 is a view corresponding to FIG. 8 in a first modification.

Specifically, as a first modification, as shown in FIG. 10, the protruding portion 66 may protrude to the rotation progress side of the inner gear 20 from the tip 64*a* of the foot portion 64.

As a second modification, as the shape of the curving protruding surface having the curvature in the axial direction, the protruding portion 66 may protrude, for example, in a shape of a spherical surface.

Figure 11:
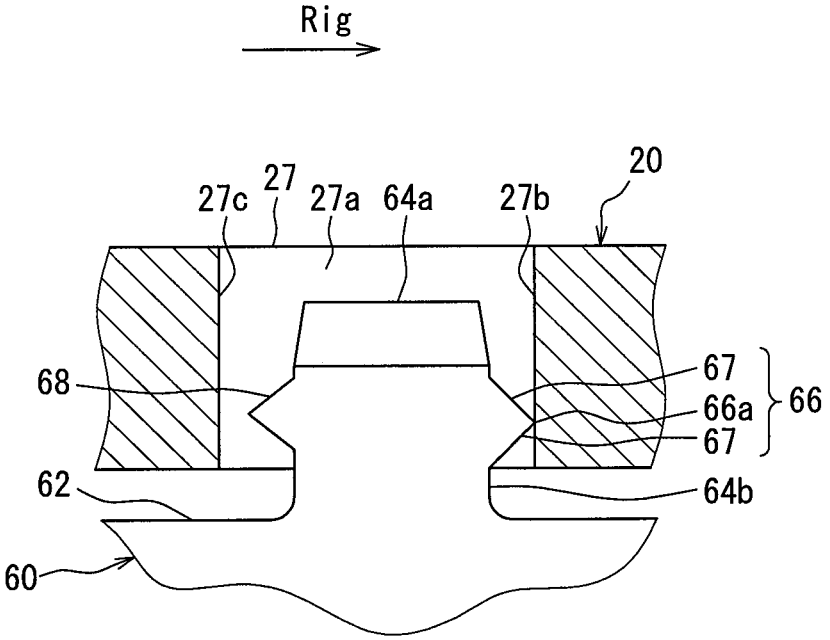
FIG. 11 is a view corresponding to FIG. 8 in a third modification.

As a third modification, the protruding portion 66 having the width narrowed in the axial direction gradually to the top portion 66*a*, as shown in FIG. 11, can employ a shape which has an inclined surface 67 inclined in the axial direction and which has a pointed top portion 66*a*.

As a fourth modification, the protruding portions 66 do not need to protrude from all of the foot portions 64 but may protrude from one or more foot portions of the plurality of foot portions 64.

As a fifth modification, the joint member 60 does not need to have the reverse protruding portions 68.

Figure 12:
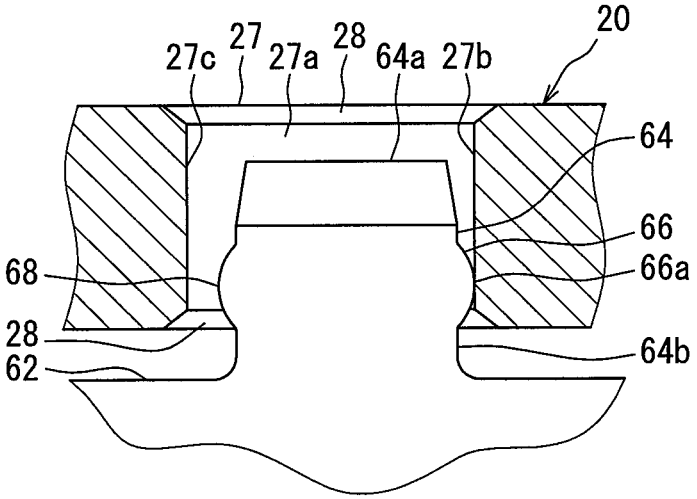
FIG. 12 is a view corresponding to FIG. 8 in a sixth modification.

As a sixth modification, the insertion hole 27, as shown in FIG. 12, may have a tapered surface 28 at the edge portion. In the joint member 60 having the protruding portions 66, in a case where the rotary shaft 4*a* is shifted in position and the joint member 60 is inclined, it is possible to prevent the foot portion 64 from being brought into contact with the edge portion including the tapered surface 28 of the insertion hole 27 formed in this manner.

As a seventh modification, the insertion hole 27 does not need to have the plane portion 27*b* along the radial direction on the inner circumferential wall 27*a* on the rotation progress side with respect to the protruding portion 66. For example, the insertion hole 27 may have a cross-sectional shape of a circular shape, an ellipsoidal shape, or the like.

As an eighth modification, if the insertion hole 27 is depressed along the axial direction, the insertion hole 27 does not need to be passed through to the depressed bottom portion 16*c* side.

As a ninth modification, the fuel pump 100 may suck and discharge gasoline other than the light oil or a liquid fuel equivalent to the gasoline as the fuel.

Second Embodiment

Hereinafter, a second embodiment will be described on the basis of the drawings.

Figure 13:
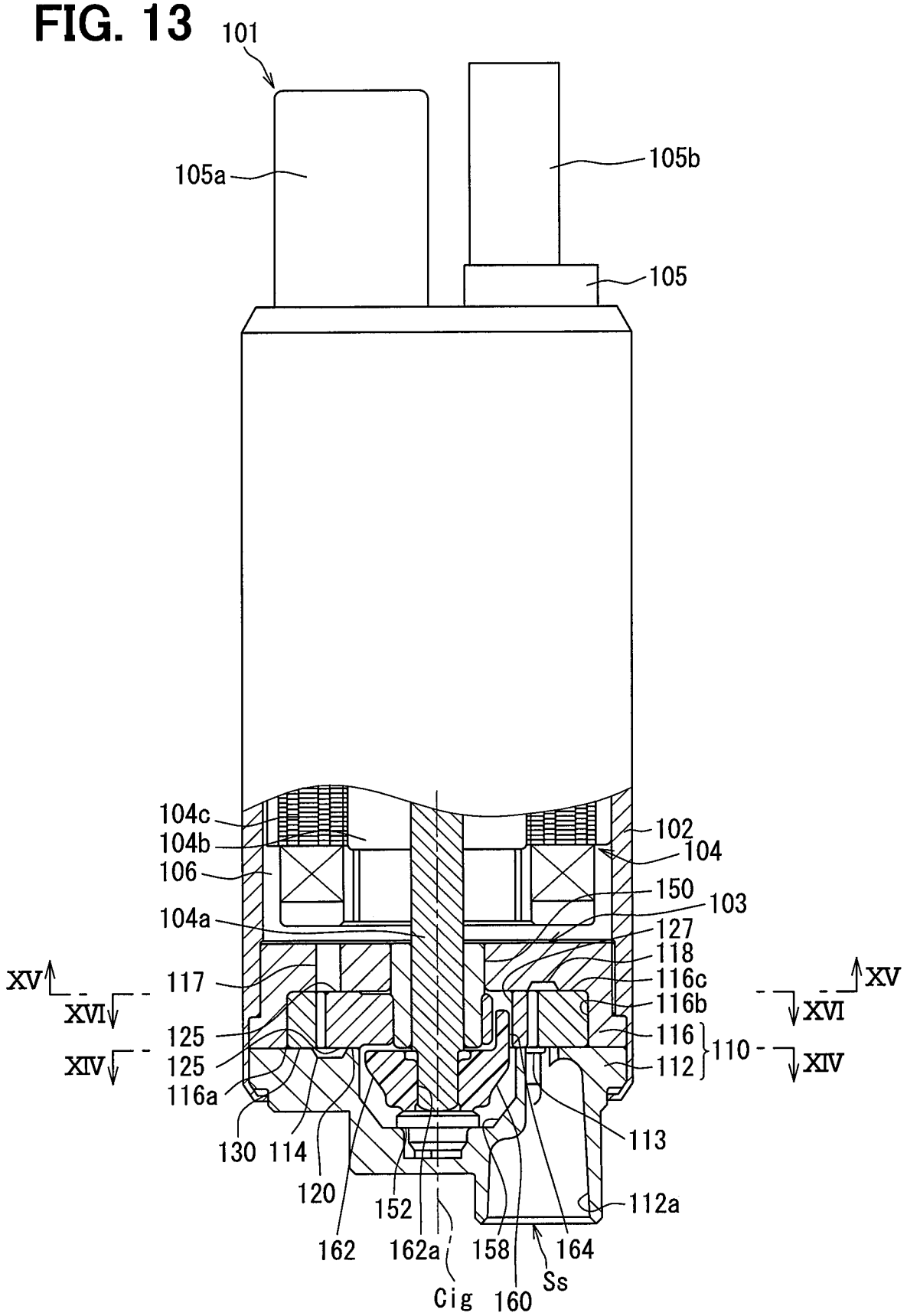
FIG. 13 is a front view, partly in cross section, to show a fuel pump according to a second embodiment.

As shown in FIG. 13, a fuel pump 101 according to the second embodiment is a displacement type trochoid pump which is mounted in a vehicle. The fuel pump 101 is provided with a pump main body 103, which is received in a circular cylindrical pump body 102, and a side cover 105, which is projected to the outside from an end opposite to the pump main body 103 across an electric motor 104 in an axial direction. Here, the side cover 105 is provided with an electric connector 105*a* to energize the electric motor 104 and a discharge port 105*b* to discharge fuel. In this fuel pump 101, when electricity is supplied from an external circuit via the electric connector 105*a*, a rotary shaft 104*a* of the electric motor 104 is rotated and driven. As a result, the fuel sucked and pressurized by the rotation of an outer gear 130 and an inner gear 120 of the pump main body 103 by the use of a driving force of the rotary shaft 104*a* included by the electric motor 104 is discharged from the discharge port 105*b*. In this regard, the fuel pump 101 discharges a light oil having higher viscosity than gasoline as the fuel.

In the present embodiment, a brushless motor of an inner rotor type is employed as the electric motor 104. The brushless motor includes magnets 104*b* arranged at four poles and coils 104*c* arranged in six slots. When an IGnition of a vehicle is turned ON or an accelerator pedal of the vehicle is pressed down, in response to this operation, the electric motor 104 performs a positioning control to rotate the rotary shaft 104*a* to a drive rotation side or a drive rotation reverse side. Then, the electric motor 104 performs a drive control to rotate the rotary shaft 104*a* to the drive rotation side from a position positioned by the positioning control.

Here, the drive rotation side indicates a positive direction side in the rotation direction Rig in a circumferential direction of the inner gear 120. Further, the drive rotation reverse side indicates a negative direction side in the rotation direction Rig in the circumferential direction of the inner gear 120.

Hereinafter, the pump main body 103 will be described in detail. The pump main body 103 is provided with a pump housing 110, the inner gear 120, the outer gear 130, and a joint member 160. Here, the pump housing 110 is made by combining a pump cover 112 with a pump casing 116.

The pump cover 112 is formed of metal in a shape of a circular disk. The pump cover 112 is projected to the outside from an end opposite to the side cover 105 across the electric motor 104 of the pump body 102 in the axial direction of the pump body 102.

Figure 14:
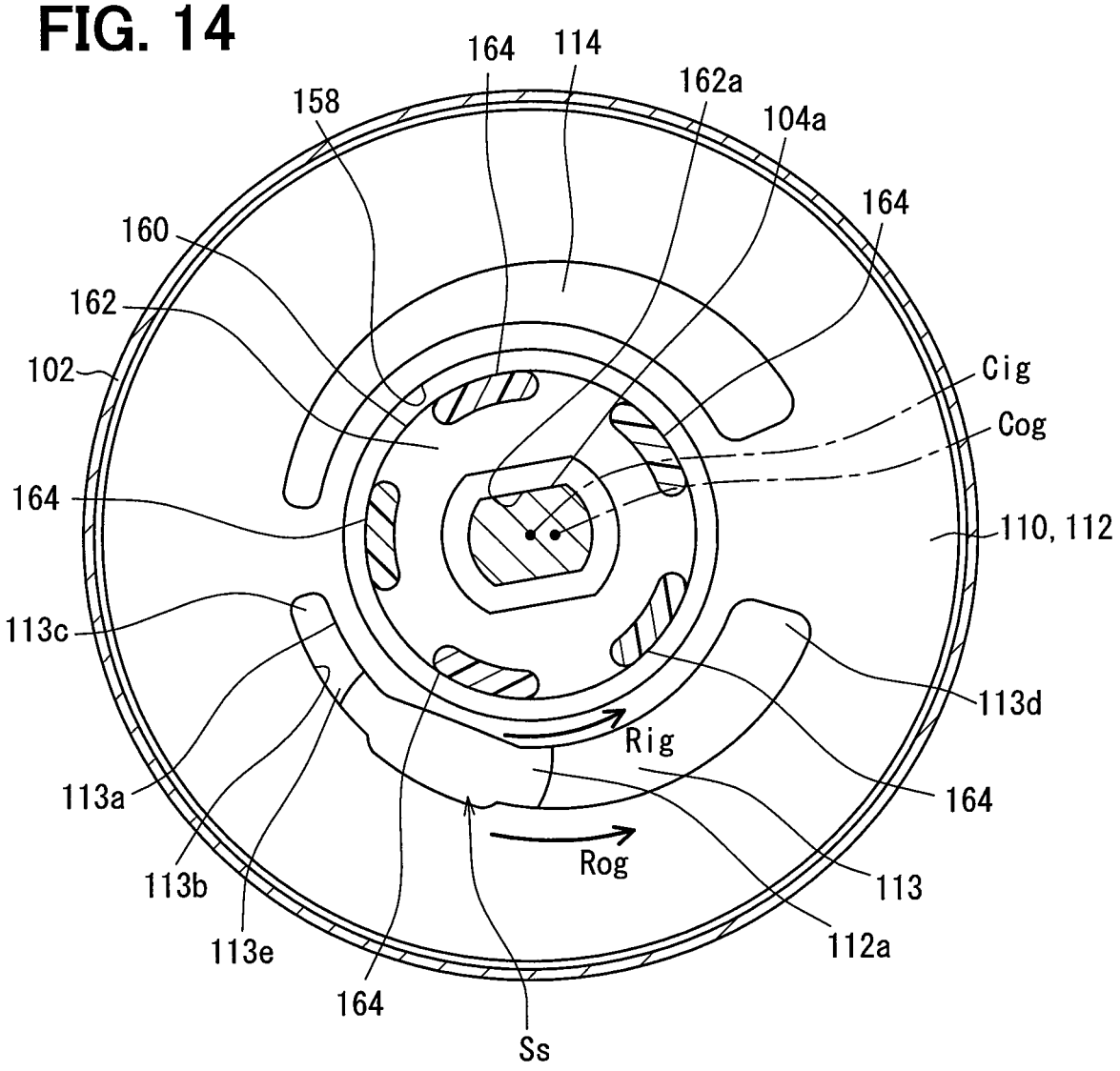
FIG. 14 is a sectional plan view when a section taken along a line XIV-XIV in FIG. 13 is viewed on a plan view.

The pump cover 112 shown in FIGS. 13 and 14 forms a suction port 112*a* formed in a shape of a circular cylindrical hole and a suction passage 113 formed in a shape of an arc groove so as to suck the fuel from the outside. The suction port 112*a* is passed through a specified opening portion Ss, which is eccentric from an inner center line Cig of the inner gear 120 of the pump cover 112, along the axial direction of the pump cover 112. The suction passage 113 is opened on a pump casing 116 side of the pump cover 112. As shown in FIG. 14, an inner circumferential portion 113*a* of the suction passage 113 is extended to a length less than half a circumference along the rotation direction Rig of the inner gear 120 (see also FIG. 6). An outer circumferential portion 113*b* of the suction passage 113 is extended to a length less than half a circumference along a rotation direction Rog of the outer gear 130.

Here, the suction passage 113 has a width expanded gradually to a finish end portion 113*d* of the rotation directions Rig, Rog from a start end portion 113*c*. Further, the suction passage 113 has the suction port 112*a* opened at the opening portion Ss of a groove bottom portion 113*e*, thereby communicating with the suction port 112*a*. As especially shown in FIG. 14, in the whole region of the opening portion Ss in which the suction port 112*a* is opened, the width of the suction passage 113 is set smaller than a width of the suction port 112*a*.

Further, the pump cover 112 forms an arrangement space 158, which is formed in a shape of a depressed hole and in which a main body portion 162 of the joint member 160 is arranged in such a way as to rotate, at a position opposite to the inner gear 120 on the inner center line Cig.

Figure 15:
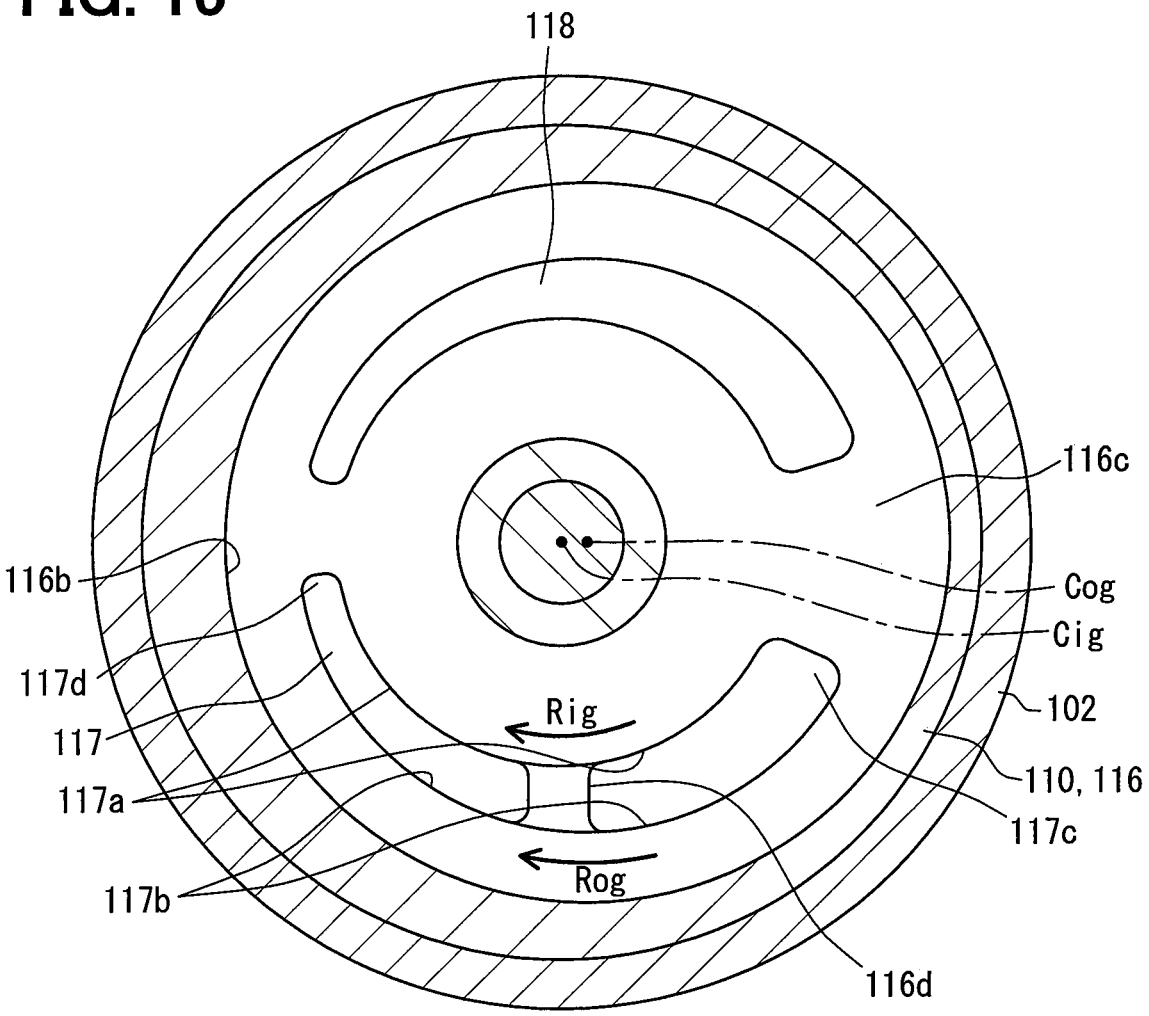
FIG. 15 is a sectional plan view when a section taken along a line XV-XV in FIG. 13 is viewed on a plan view.
Figure 16:
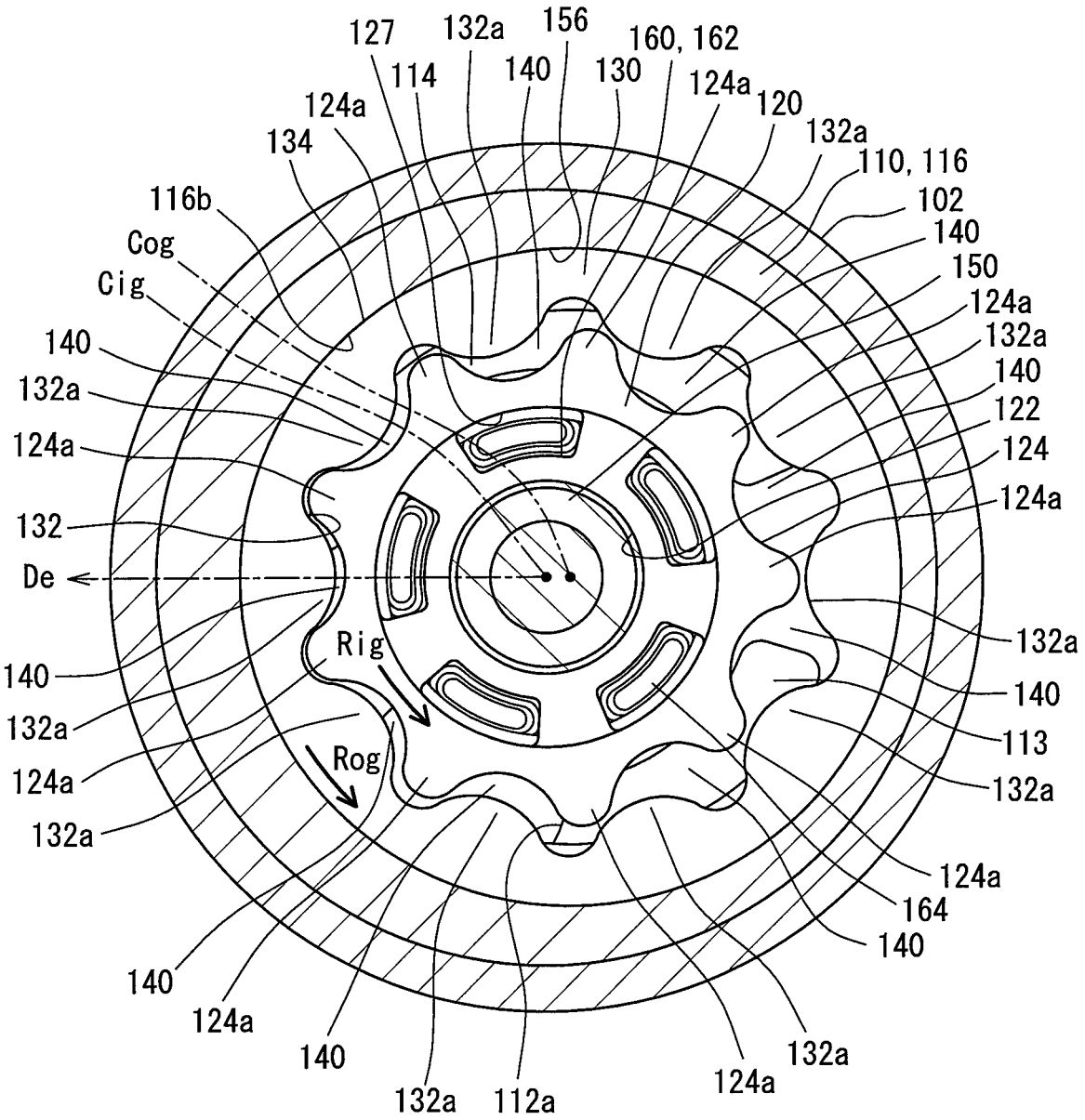
FIG. 16 is a sectional plan view when a section taken along a line XVI-XVI in FIG. 13 is viewed on a plan view.

The pump casing 116 shown in FIGS. 13, 15, and 16 is formed of metal in a shape of a closed-end circular cylinder. Of the pump casing 116, an opening portion 116*a* is covered by the pump cover 112 and hence is tightly closed in the whole circumference. An inner circumferential portion 116*b* of the pump casing 116, as especially shown in FIGS. 13 and 16, is formed in a shape of a circular cylindrical hole which is eccentric from the inner center line Cig of the inner gear 120.

The pump casing 116 forms a discharge passage 117 formed in a shape of an arc hole so as to discharge the fuel from the discharge port 105*b* through a fuel passage 106 between the pump body 102 and the electric motor 104. The discharge passage 117 is passed through a depressed bottom portion 116*c* of the pump casing 116 along the axial direction. As especially shown in FIG. 15, an inner circumferential portion 117*a* of the discharge passage 117 is extended to a length less than half a circumference along the rotation direction Rig of the inner gear 120. An outer circumferential portion 117*b* of the discharge passage 117 is extended to a length less than half a circumference along the rotation direction Rog of the outer gear 130. Here, the discharge passage 117 has a width narrowed gradually to a finish end portion 117*d* from a start end portion 117*c*.

Further, the pump casing 116 has a reinforcing rib 116*d* provided in the discharge passage 117. The reinforcing rib 116*d* is a rib which is formed integrally with the pump casing 116 and which is extended over the discharge passage 117 in an intersecting direction with respect to the rotation direction Rig of the inner gear 120 to thereby reinforce the pump casing 116.

At a portion opposite to the suction passage 113 across the pump chamber 140 (which will be described later in detail) between both of the inner gear 120 and the outer gear 130 of the depressed bottom portion 116*c* of the pump casing 116, as especially shown in FIG. 15, a suction groove 118 formed in a shape of an arc groove is formed in correspondence to a shape in which the suction passage 113 is projected in the axial direction. In this way, in the pump casing 116, the discharge passage 117 and the suction groove 118 are formed in such a way that their contours are nearly symmetric to each other with respect to a line. On the other hand, as especially shown in FIG. 14, at a portion opposite to the discharge passage 117 across the pump chamber 140 of the pump cover 112, a discharge groove 114 formed in a shape of an arc groove is formed in correspondence to a shape in which the discharge passage 117 is projected in the axial direction. In this way, in the pump cover 112, the suction passage 113 and the discharge groove 114 are formed in such a way that their contours are nearly symmetric to each other with respect to a line.

As shown in FIG. 13, on the inner center line Cig of the depressed bottom portion 116*c* of the pump casing 116, a radial bearing 150 is fitted and fixed so as to journal the rotary shaft 104*a* of the electric motor 104 in the radial direction. On the other hand, on the inner center line Cig of the pump cover 112, a thrust bearing 152 is fitted and fixed so as to journal the rotary shaft 104*a* in the axial direction.

As shown in FIGS. 13 and 16, the depressed bottom portion 116*c* and an inner circumferential portion 116*b* of the pump casing 116 form a housing space 156 to house the inner gear 120 and the outer gear 130 in cooperation with the pump cover 112. Each of the inner gear 120 and the outer gear 130 is a so-called trochoid gear whose tooth shape curve is a trochoid curve.

The inner gear 120 shown in FIGS. 13, 16 to 18 has the inner center Cig in common with the rotary shaft 104*a*, so that the inner gear 120 is eccentrically arranged in the housing space 156. The inner gear 120 has its inner circumferential portion 122 journaled in the radial direction by the radial bearing 150 and has its sliding surface 125 on both sides in the axial direction journaled by the depressed bottom portion 116*c* of the pump casing 116 and the pump cover 112.

Further, the inner gear 120 has an insertion hole 127 depressed along the axial direction at a position opposite to the arrangement space 158. The insertion hole 127 in the present embodiment is formed plurally (in the present embodiment, by five) at equal intervals in a circumferential direction along the rotation direction Rig, and each of the insertions holes 127 is passed through to the depressed bottom portion 116*c* side. Each of the insertion holes 127 has a corresponding foot portion 164 of the joint portion 160 inserted thereinto, whereby a driving force of the rotary shaft 104*a* is transmitted to the inner gear 120 via the joint member 160. In this way, the inner gear 120 can make the sliding surface 125 slide to the depressed bottom portion 116*c* and the pump cover 112 according to the rotation of the rotary shaft 104*a* of the electric motor 104, whereby the inner gear 120 can be rotated in the circumferential direction around the inner center line Cig.

The inner gear 120 has a plurality of external teeth 124*a*, which are arranged at equal intervals in the circumferential direction along the rotation direction Rig, on an outer circumferential portion 124. Each of the external teeth 124*a* can be opposed in the axial direction to each of the suction passage 113 and the discharge passage 117 and each of the discharge groove 114 and the suction groove 118 according to the rotation of the inner gear 120, whereby each of the external teeth 124*a* is inhibited from being attached to the depressed bottom portion 116*c* and the pump cover 112.

Figure 17:
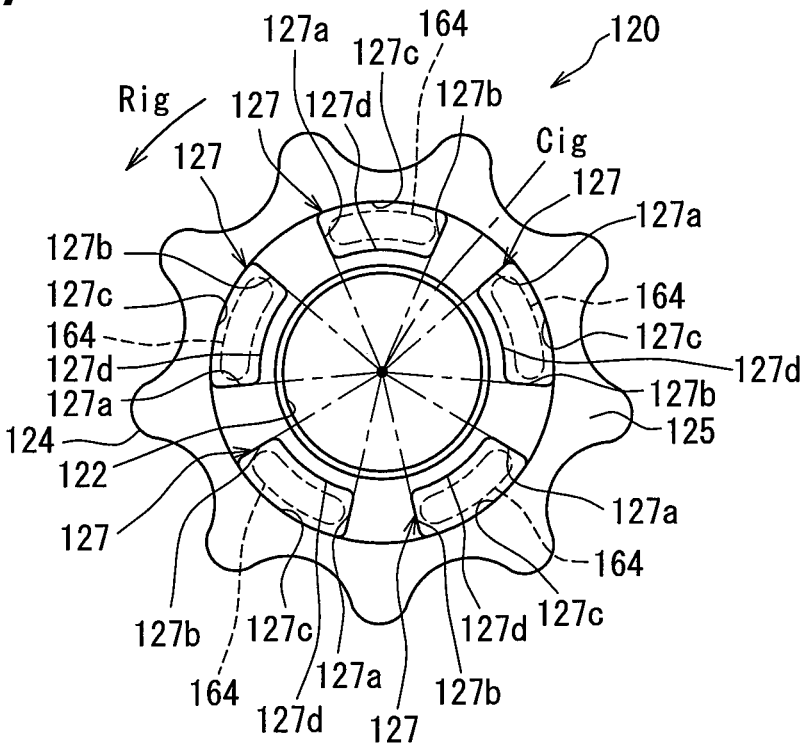
FIG. 17 is a plan view of an inner gear according to a second embodiment.
Figure 18:
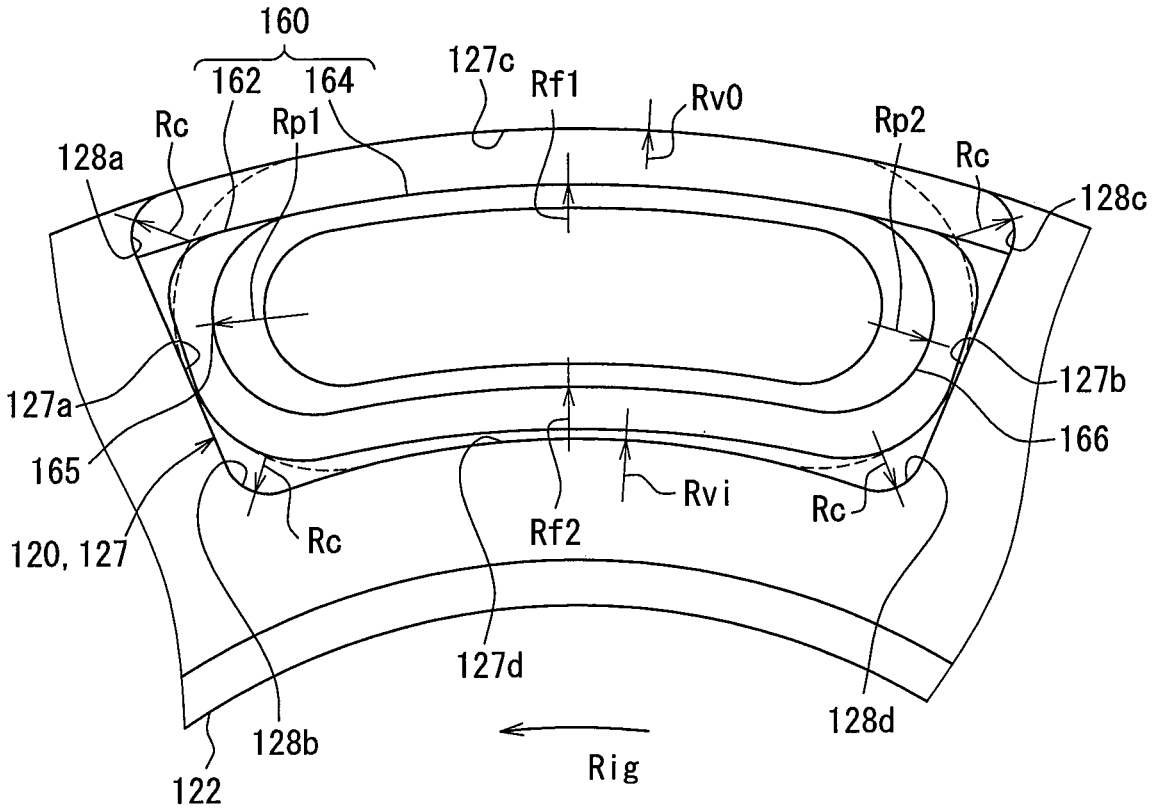
FIG. 18 is a partial enlarged view to show a relationship between an insertion hole and a foot portion of the second embodiment.
Figure 19:
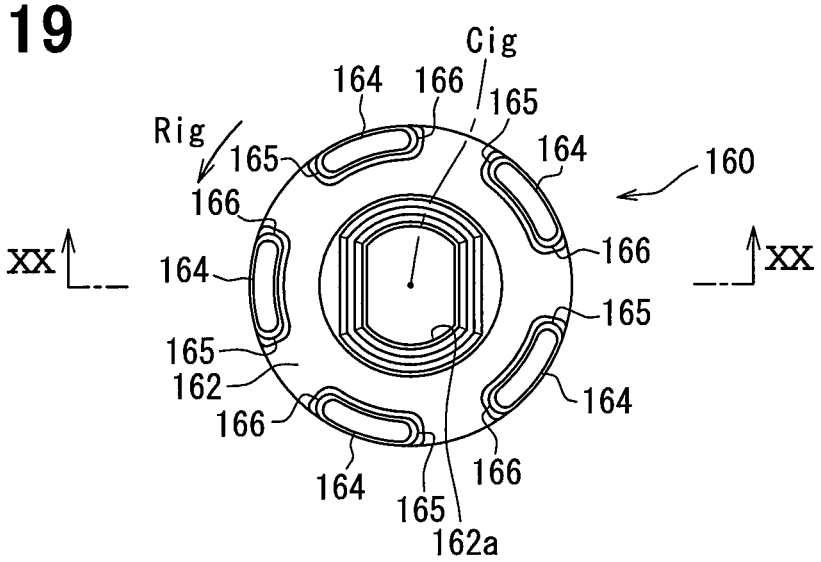
FIG. 19 is a plan view of a joint member according to the second embodiment.

Each of the insertion holes 127 of the present embodiment, as especially shown in FIGS. 17 and 18, has a plane portion 127*a*, a reverse plane portion 127*b*, an outer circumferential curved portion 127*c*, an inner circumferential curved portion 127*d*, and four corner portions 128*a*, 128*b*, 128*c*, and 128*d* formed on each inner circumferential wall. Each of the plane portions 127*a* is formed in a shape of a radial plane along the radial direction of the inner gear 120 on an inner wall which is the drive rotation side to the inserted foot portion 164. Each of the plane portions 127*a* faces the drive rotation reverse side. Each of the reverse plane portions 127*b* is formed in a shape of a radial plane along the radial direction of the inner gear 120 on an inner wall which is the drive rotation reverse side to the inserted foot portion 164. Each of the reverse plane portions 127*b* faces the drive rotation side.

Each of the outer circumferential curved portions 127*c* is formed in a shape of a curved surface curved along the circumferential direction on an inner wall on an outer circumferential side which is opposite in the radial direction to the inserted foot portion 164. Each of the inner circumferential curved portions 127*d* is formed in a shape of a curved surface curved along the circumferential direction on an inner wall on an inner circumferential side which is opposite in the radial direction to the inserted foot portion 164.

In each of the insertion holes 127, the corner portion 128*a* shown in an enlarged scale in FIG. 18 is adjacent to the plane portion 127*a* and the outer circumferential curved portion 127*c*. In each of the insertion holes 127, the corner portion 128*b* is adjacent to the plane portion 127*a* and the inner circumferential curved portion 127*d*. In each of the insertion holes 127, the corner portion 128*c* is adjacent to the reverse plane portion 127*b* and the outer circumferential curved portion 127*c*. In each of the insertion holes 127, the corner portion 128*d* is adjacent to the reverse plane portion 127*b* and the inner circumferential curved portion 127*d*. Each of the corner portions 128*a* to 128*d* is curved in a depressed shape when viewed on a plan view, thereby being smoothly connected to respective adjacent portions. As shown in FIG. 18, a radius of curvature Rc of each of the corner portions 128*a* to 128*d* is set smaller than radii of curvature Rp1 and Rp2 of a top portion 165 and a reverse top portion 166 (which will be described later in detail) of the inserted foot portion 164. Here, a state when viewed on a plan view in the present embodiment means a state in which a plane or cross section vertical to the axial direction is viewed from the axial direction, and FIGS. 14 to 19 in the present embodiment correspond to this state.

The outer gear 130, as shown in FIGS. 13 and 16, is eccentric with respect to the inner center line Cig of the inner gear 120, thereby being arranged coaxially to the housing space 156 in the housing space 156. In this way, the inner gear 120 is eccentric to an eccentric direction De as one radial direction with respect to the outer gear 130. An outer circumferential portion 134 of the outer gear 130 is journaled in the radial direction by an inner circumferential portion 116*b* of the pump casing 116 and is journaled in the axial direction by the depressed bottom portion 116*c* of the pump casing 116 and the pump cover 112. Since the outer gear 130 is journaled in this manner, the outer gear 130 can be rotated in a specified rotation direction Rog around an outer center line Cog which is eccentric from the inner center line Cig.

The outer gear 130 has a plurality of internal teeth 132*a*, which are arranged at equal intervals in the rotation direction Rog, formed on the inner circumferential portion 132. Here, the number of the internal teeth 132*a* in the outer gear 130 is set larger by one than the number of the external teeth 124*a* in the inner gear 120. Each of the internal teeth 132*a* can be opposed in the axial direction to each of the suction passage 113 and the discharge passage 117 and each of the discharge groove 114 and the suction groove 118 according to the rotation of the outer gear 130, whereby each of the internal teeth 132*a* is inhibited from being attached to the depressed bottom portion 116*c* and the pump cover 112.

The inner gear 120 is engaged with the outer gear 130 in a state where inner gear 120 is relatively eccentric to the eccentric direction De with respect to the outer gear 130. In this way, a plurality of pump chambers 140 are formed continuously between both of the inner gear 120 and the outer gear 130 in the housing space 156. When the outer gear 130 and the inner gear 120 are rotated, each of the pump chambers 140 has its volume enlarged or reduced.

When both of the inner gear 120 and the outer gear 130 are rotated, the pump chamber 140, which is opposed to and communicates with the suction passage 113 and the suction groove 118, has its volume enlarged. As a result, the fuel is sucked into the pump chamber 140 through the suction passage 113 from the suction port 112*a*. Here, the suction passage 113 has its width enlarged gradually to the finish end portion 113*d* from the start end portion 113*c* (see also FIG. 14), so that the amount of the fuel sucked through the suction passage 113 depends on the amount of enlarged volume of the pump chamber 140.

When both of the inner gear 120 and the outer gear 130 are rotated, the pump chamber 140, which is opposed to and communicates with the discharge passage 117 and the discharge groove 114, has its volume reduced. As a result, the fuel is discharged to the fuel passage 106 through the discharge passage 117 from the pump chamber 140. Here, the discharge passage 117 has its width reduced gradually to the finish end portion 117*d* from the start end portion 117*c* (see also FIG. 15), so that the amount of the fuel discharged through the discharge passage 117 depends on the amount of reduced volume of the pump chamber 140.

The joint member 160, as shown in FIGS. 13, 14, 16, and 18 to 20, is formed of synthetic resin, for example, polyphenylene sulfide (PPS) resin or the like, and transmits the driving force of the rotary shaft 104*a* to the inner gear 120, thereby rotating the inner gear 120 in the circumferential direction. The joint member 160 includes a main body portion 162 and the foot portions 164.

The main body portion 162 is arranged in the arrangement space 158 formed in the pump cover 112 and is formed in a shape of a circular ring having a fitting hole 162*a* opened in the center and has the rotary shaft 104*a* passed through the fitting hole 162*a*, thereby being fitted and fixed to the rotary shaft 104*a*.

The foot portion 164 is plurally provided in correspondence to the number of the insertions holes 127 of the inner gear 120. Specifically, in order to reduce the effect of a torque ripple of the electric motor 104, the foot portions 164 are provided by a number which is different from the number of the poles and the number of the slots of the electric motor 104 and which is, in particular, a prime number, that is, by five. The foot portions 64 are provided in such a way as to extend along the axial direction from a plurality of portions (in the present embodiment, five portions), which are closer to the outer circumferential side than the fitting hole 162*a* in which the main body portion 162 is fitted and fixed to the rotary shaft 104*a*. Then, the plurality of foot portions 164 are arranged at equal intervals in the circumferential direction. Each of the foot portions 164 is formed of a material having resilience in a shape extended along the axial direction and hence can be resiliently deformed. When the rotary shaft 104*a* is rotated and driven, each of the foot portions 164 is resiliently deformed and warped according to the corresponding insertion hole 127, whereby dimensional errors in the circumferential direction of each of the insertion holes 127 and each of the foot portions 164, which are caused at the time of manufacture, are absorbed and hence each of the foot portions 164 is brought into contact with each of the insertion holes 127. In this way, the joint member 160 transmits the driving force of the rotary shaft 104*a* to the inner gear 120 by way of the plurality of foot portions 164.

Figure 20:
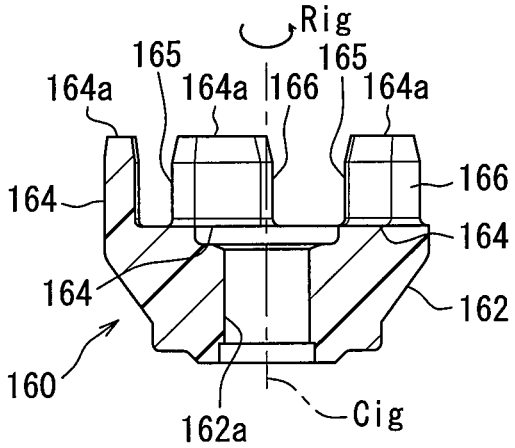
FIG. 20 is a section view taken along a line XX-XX in FIG. 19.

Each of the foot portions 164 formed in this manner is inserted into the corresponding insertion hole 127 with a clearance. A tip 164*a* of each of the foot portions 164, as especially shown in FIG. 13, is extended to the electric motor 104 side farther than a center of gravity of the inner gear 120 in the axial direction with respect to the insertion hole 127 passed through the inner gear 120 in the axial direction but is not extended to the outside of the insertion hole 127. Further, the tip 164*a* of each of the foot portions 164, as especially shown in FIG. 20, is formed in a shape of a guide so as to facilitate a combining work at the time of manufacture.

Each of the foot portions 164 has the top portion 165 opposite to the plane portion 127*a* in the circumferential direction. The top portion 165 is curved in a protruding shape when viewed on the plan view, in particular in the present embodiment, is formed in a shape of a semi-circular column having a generating line along the axial direction.

Further, each of the foot portions 164 has the reverse top portion 166 opposite to the reverse plane portion 127*b* in the circumferential direction. The reverse top portion 166 is curved in a protruding shape when viewed on the plan view, especially in the present embodiment, is formed in a shape of a semi-circular column having a generating line along the axial direction.

A portion between the top portion 165 and the reverse top portion 166 of each of the foot portions 164, which is provided with the top portion 165 and the reverse top portion 166, is curved along the circumferential direction of the inner gear 120 in accordance with a shape of the outer circumferential curved portion 127*c* and a shape of the inner circumferential curved portion 127*d* of the insertion hole 127. Here, as especially shown in FIG. 18, each of a radius of curvature Rvo of the outer circumferential curved portion 127*c*, a radius of curvature Rvi of the inner circumferential curved portion 127*d*, a radius of curvature Rf1 on the outer circumferential side of the foot portion 164, and a radius of curvature Rf2 on the inner circumferential side of the foot portion 164 is set according to a distance to the inner center line Cig. In more detail, the radii of curvature Rf1 and Rf2 are set larger than the radius of curvature Rvi and smaller than the radius of curvature Rvo. In the present embodiment, substantially, each of the radii of curvature Rvo, Rvi, Rf1, and Rf2 is set to be equal to the distance to the inner center line Cig, whereby the center of curvature is on the inner center line Cig.

In this construction, when the rotary shaft 104*a* is rotated to the drive rotation reverse side by the positioning control of the electric motor 104, the top portion 165 is separated from the plane portion 127*a* whereas the reverse top portion 166 collides with the reverse plane portion 127*b* and rotates the inner gear 120 in a negative direction of the rotation direction Rig of the circumferential direction in a state where the reverse top portion 166 is in contact with the reverse plane portion 127*b*. Then, when the drive control of the electric motor 104 is started, this time, the reverse top portion 166 is separated from the reverse plane portion 127*b*, whereas the top portion 165 collides with the plane portion 127*a* and rotates the inner gear 120 in the rotation direction Rig of the circumferential direction in a state where the top portion 165 is in contact with the plane portion 127*a*. When the fuel pump 101 of the present embodiment is started up, the fuel pump 101 repeatedly endures the collisions described above, whereas when the fuel pump 101 is driven, the fuel pump 101 sequentially sucks the fuel into each of the pump chambers 140 and discharges the fuel from each of the pump chambers 140.

An operation and effect of the present embodiment described above will be described below.

According to the present embodiment, when the rotary shaft 104*a* of the electric motor 104 is rotated and driven, the joint member 160 having the main body portion 162 fitted to the rotary shaft 104*a* is rotated together with the rotary shaft 104*a*. Then, the foot portions 164 extended in the axial direction from the main body portion 162 are inserted into the insertion holes 127 of the inner gear 120 with the clearance and hence the inner gear 120 is rotated in the circumferential direction by way of the joint member 160. Here, in the insertion hole 127, the inner wall on the drive rotation side with respect to the foot portion 164 has the plane portion 127*a* along the radial direction. On the other hand, in the foot portion 164, the top portion 165 curved in the protruding shape when viewed on the plan view is opposed in the circumferential direction to the plane portion 127*a*. According to this construction, even in a case where a contact position or a contact angle of the foot portion 164 with respect to the insertion hole 127 is changed, when the top portion 165 is brought into contact with the plane portion 127*a*, it is possible to inhibit a component force in the radial direction from being generated in the driving force transmitted to the inner gear 120 from the joint member 160 and to inhibit a load from being concentrated at a specified portion of the joint member 160, so that the inner gear 120 can be rotated efficiently for a long time. From the above, it is possible to provide the fuel pump 101 having a high pump efficiency.

Further, according to the present embodiment, each of the insertion holes 127 has the corner portions 128*a* and 128*b* which are adjacent to the plane portion 127*a* and which are curved in the depressed shape when viewed on the plan view and the radius of curvature Rc in each of the corner portions 128*a* and 128*b* is smaller than the radius of curvature Rp1 at the top portion 165. By setting at such a radius of curvature Rp1, the plane portion 127*a* can be set wide in the insertion hole 127, so that even in a case where the contact position or the contact angle of the foot portion 164 to the insertion hole 127 is changed, the top portion 165 can be surely brought into contact with the plane portion 127*a*.

Still further, according to the present embodiment, the insertion hole 127 having the plane portion 127*a* is plurally provided and the foot portion 164 having the top portion 165 is plurally provided as a portion extending from each of the plurality of portions closer to the outer circumferential side than the fitting hole 162*a* of the main body part 162. Then, these foot portions 164 are provided in such a way as to be resiliently deformed. According to this construction, even in a case where the foot portion 164 is resiliently deformed to the outer circumferential side by a centrifugal force generated when the rotary shaft 104*a* is driven, the top portion 165 can be surely brought into contact with the plane portion 127*a*.

Still further, according to the present embodiment, the plurality of insertion holes 127 and the plurality of foot portions 164 are arranged at equal intervals in the circumferential direction. Since the insertion holes 127 and the foot portions 164 are arranged at equal intervals, it is possible to inhibit the driving force from being varied and pulsated by a rotation phase of the inner gear 120 and hence to improve the pump efficiency.

Still further, according to the present embodiment, each of the insertion holes 127 has the reverse plane portion 127*b* along the radial direction on the inner wall on the drive rotation reverse side with respect to the foot portion 164, whereas each of the foot portions 164 has the reverse top portion 166 which is opposite to the reverse plane portion 127*b* in the circumferential direction and which is curved in the protruding shape when viewed on the plan view. According to this construction, even in a case where the rotary shaft 104*a* is rotated to the drive rotation reverse side by the positioning control at the time of starting up the electric motor 104, when the reverse top portion 166 is brought into contact with the reverse plane portion 127*b*, it is possible to inhibit a component force in the radial direction from being generated in the driving force transmitted to the inner gear 120 from the joint member 160 and to inhibit a load from being concentrated at a specified portion of the joint member 160. Hence, the inner gear 120 can be rotated efficiently for a long time.

Still further, according to the present embodiment, each of the foot portions 164 is curved along the circumferential direction and each of the insertion holes 127 has the curved portions 127*c* and 127*d* curved along the circumferential direction on the inner wall opposite in the axial direction to the foot portion 164. According to these curved portions 127*c* and 127*d*, when the top portion 165 is brought into contact with the plane portion 127*a* or when the reverse top portion 166 is brought into contact with the reverse plane portion 127*b*, the top portion 165 or the reverse top portion 166 can be easily brought into contact with the plane portion 127*a* or the reverse plane portion 127*a* at a vertical contact angle or a contact angle close to a vertical angle. Then, the curved portions 127*c* and 127*d* are curved along the circumferential direction similarly to the foot portion 164, so that the foot portion 164 is hard to be brought into contact with the curved portions 127*c* and 127*d*.

The second embodiment has been described above. However, the present disclosure is not understood to be limited to the embodiment but can be applied to various embodiments within a scope not departing from the gist of the present disclosure. Modifications of the embodiment described above will be described below.

Figure 21:
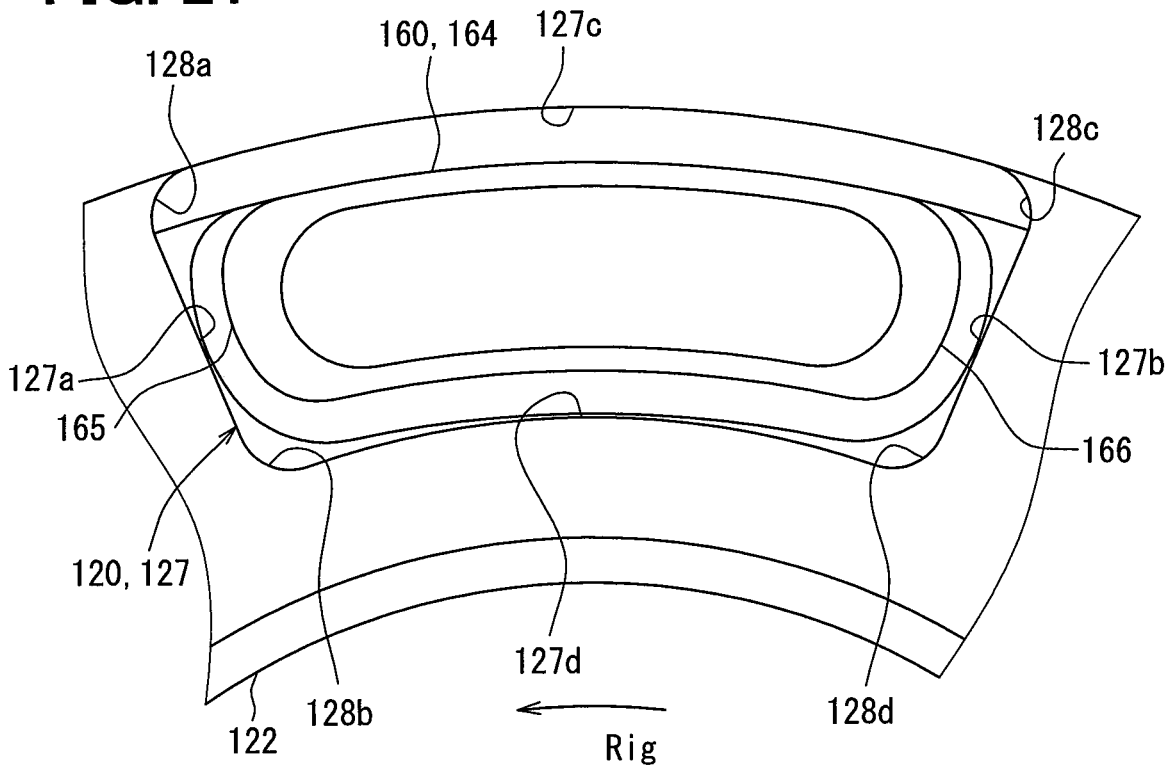
FIG. 21 is a view corresponding to FIG. 18 in an example of a tenth modification.
Figure 22:
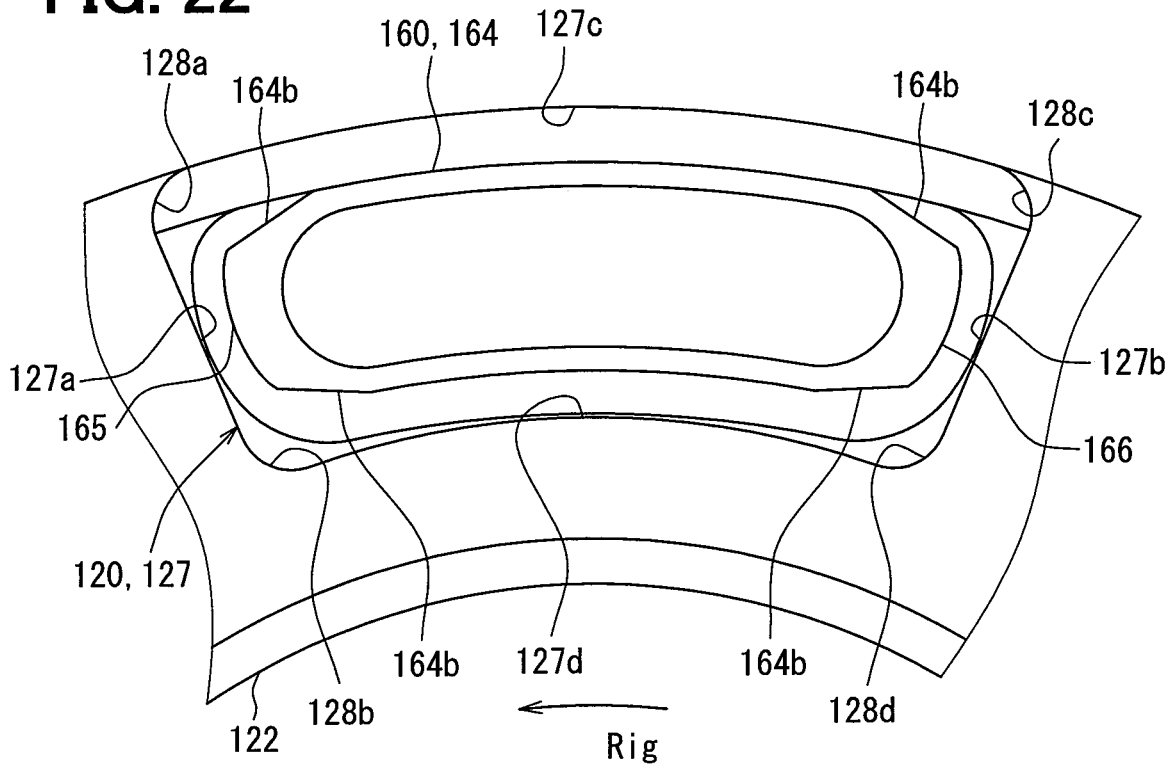
FIG. 22 is a view corresponding to FIG. 18 in another example of the tenth modification.

Specifically, as a tenth modification, as far as the top portion 165 or the reverse top portion 166 is curved in the protruding shape when viewed on the plan view, the top portion 165 or the reverse top portion 166 can employ various kinds of shapes. As shown in FIG. 21, the radius of curvature Rp1 or Rp2 of the top portion 165 or the reverse top portion 166 when viewed on the plan view may be changed according to the portions. Further, the radius of curvature Rp1 or Rp2 of the top portion 165 or the reverse top portion 166 when viewed on the plan view may be changed on the inner circumferential side and on the outer circumferential side. Still further, as shown in FIG. 22, plane-shaped portions 164*b* may be provided adjacently to the top portion 165 or the reverse top portion 166.

As an 11th modification, the joint member 160 may have the foot portions 164 formed of a material other than the synthetic resin, for example, aluminum in such a way as to be resiliently deformed.

As a 12th modification, the plurality of insertion holes 127 and the plurality of foot portions 164 may be provided at uneven intervals in the circumferential direction.

As a 13th modification, the radius of curvature Rc of each of the corner portions 128*a* to 129*d* may be the radius of curvature Rp1 on the top portion 165 or more.

As a 14th modification, the inner wall opposite in the radial direction to the foot portion 164 may be formed in a plane shape.

As a 15th modification, if each of the insertion holes 127 is depressed along the axial direction, each of the insertion holes 127 may be formed in a shape of a closed-end hole which is not passed through to the depressed bottom portion side.

As a 16th modification, the fuel pump 101 may suck and discharge gasoline other than the light oil, or a liquid fuel equivalent to the gasoline as the fuel.

While the present disclosure has been described with reference to embodiments thereof, it is to be understood that the disclosure is not limited to the embodiments and constructions. The present disclosure is intended to cover various modification and equivalent arrangements. In addition, the various combinations and configurations, other combinations and configurations, including more, less or only a single element, are also within the spirit and scope of the present disclosure.

The invention claimed is:

1. A fuel pump comprising:

an outer gear that includes a plurality of internal teeth;

an inner gear that includes a plurality of external teeth and is eccentric from the outer gear in an eccentric direction to be engaged with the outer gear;

a pump housing that rotatably accommodates the outer gear and the inner gear;

an electric motor that includes a rotary shaft which is rotary-driven; and a joint member that connects together the inner gear and the rotary shaft, wherein:

the outer gear and the inner gear expand and contract volume of a plurality of pump chambers formed between both the gears, and rotate to suction fuel into the plurality of pump chambers and then discharge fuel from the plurality of pump chambers sequentially;

the inner gear includes multiple insertion holes, each of which is depressed along its axial direction; and the joint member includes:

a main body portion that is fitted to the rotary shaft;

multiple foot portions, each of which extends from the main body portion along the axial direction and is inserted in each of the insertion holes with a clearance therebetween; and multiple protruding portions, each of which protrudes from the foot portion toward a rotation progress side of the inner gear and has its width in the axial direction further narrowed toward a top portion of the protruding portion, wherein the foot portions are arranged in a circumferential direction of the inner gear in such a way that none of them is located at a point symmetric position with any other foot portions around an inner center line of the inner gear.

2. The fuel pump according to claim 1, wherein the width of the protruding portion has another end, which is narrowed toward the main body portion, so that the protruding portion is separated from the main body portion with a predetermined axial distance between the other end of the width of the protruding portion and the main body portion.

* * * * *